US007920820B2

(12) United States Patent
Kitta et al.

(10) Patent No.: US 7,920,820 B2
(45) Date of Patent: Apr. 5, 2011

(54) BOOKBINDING APPARATUS AND IMAGE FORMING SYSTEM COMPRISING THE SAME

(75) Inventors: Kouichi Kitta, Kousyuu (JP); Akihiko Tsukui, Kai (JP); Hideki Aoyagi, Yamanashi-ken (JP); Suguru Maruyama, Yamanashi-ken (JP)

(73) Assignee: Nisca Corporation, Minamikoma-Gun, Yamanashi (JP)

( * ) Notice: Subject to any disclaimer, the term of this patent is extended or adjusted under 35 U.S.C. 154(b) by 783 days.

(21) Appl. No.: 12/000,220

(22) Filed: Dec. 11, 2007

(65) Prior Publication Data

US 2008/0145187 A1 Jun. 19, 2008

(30) Foreign Application Priority Data

Dec. 14, 2006 (JP) ..... 2006-337639

(51) Int. Cl.
*G03G 15/00* (2006.01)

(52) U.S. Cl. ..... 399/408; 399/407; 412/4; 412/5; 412/14; 412/19; 412/37; 270/58.08

(58) Field of Classification Search ..... 399/407, 399/408; 412/4, 5, 14, 19, 37; 270/58.08
See application file for complete search history.

(56) References Cited

U.S. PATENT DOCUMENTS

| | | | | |
|---|---|---|---|---|
| 4,496,617 | A * | 1/1985 | Parker | 428/55 |
| 5,871,323 | A * | 2/1999 | Clark | 412/4 |
| 7,695,229 | B2 * | 4/2010 | Cobene et al. | 412/8 |
| 7,845,890 | B2 * | 12/2010 | Sasamoto et al. | 412/13 |
| 2008/0267735 | A1 * | 10/2008 | Hama | 412/37 |

FOREIGN PATENT DOCUMENTS

| | | |
|---|---|---|
| JP | 2004-209869 | 7/2004 |
| JP | 2005-104063 | 4/2005 |

* cited by examiner

*Primary Examiner* — Judy Nguyen
*Assistant Examiner* — Andy L Pham
(74) *Attorney, Agent, or Firm* — Manabu Kanesaka

(57) ABSTRACT

A bookbinding apparatus includes a collecting device, a bookbinding path, a bundle conveying device for transferring the sheet bundle to a paste applying position and then to a cover binding position, a paste applying device for applying an adhesive to a spine part of the sheet bundle, and a cover feeding path. A cover binding device binds the sheet bundle with the adhesive to the cover sheet, and a cover binding control device controls the cover binding device. The cover binding device includes a back folding press member and a back abutting plate member. The cover sheet is sandwiched between the back abutting plate member and the spine part of the sheet bundle with a small gap between the back abutting plate member and the spine part. The cover binding control device adjusts a size of the gap depending on a thickness of the cover sheet when folded back.

8 Claims, 14 Drawing Sheets

FIG.6(b)a
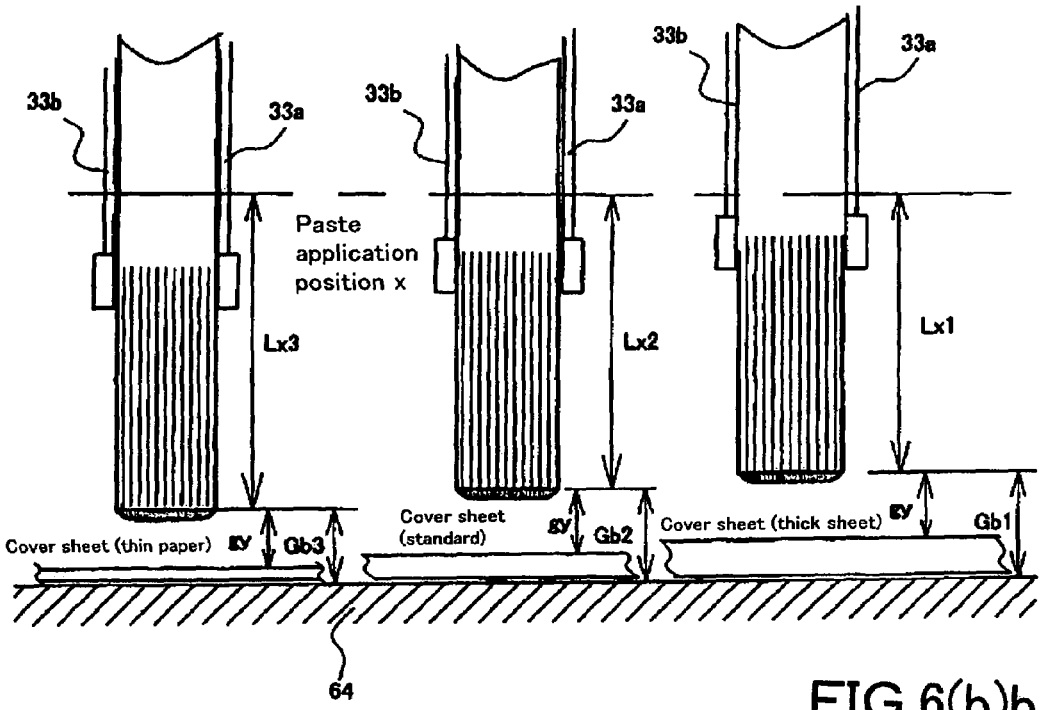
FIG.6(b)b
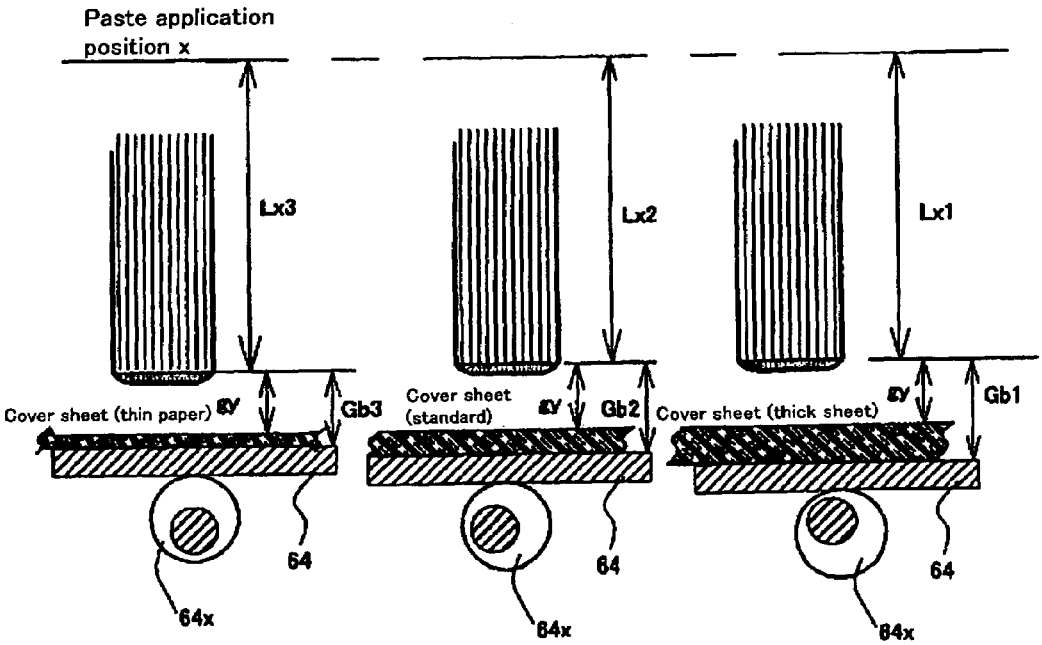

With thick sheet bundle

With thin sheet bundle

With thick sheet bundle

With thin sheet bundle

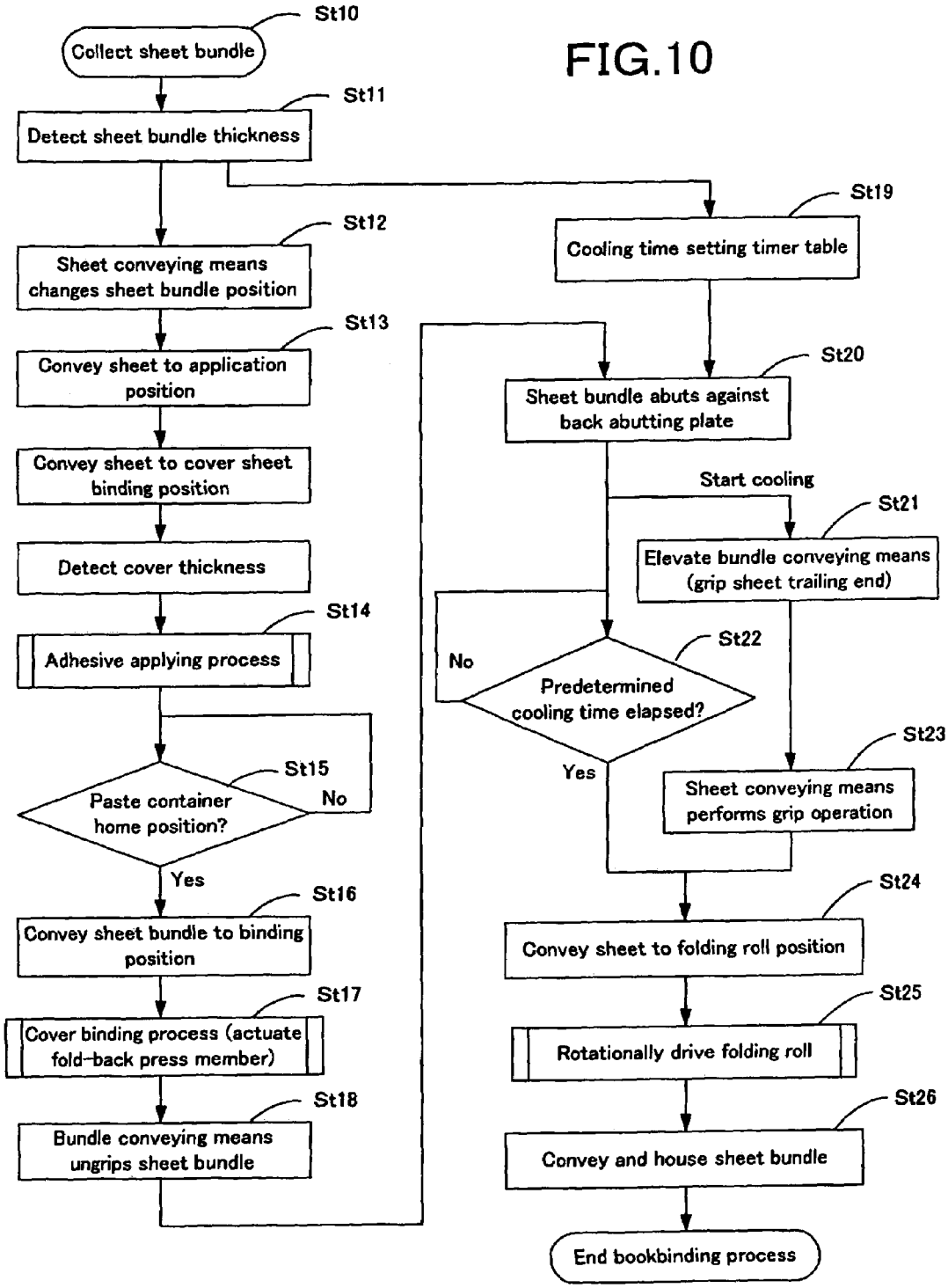
FIG.10
St10
Collect sheet bundle
St11
Detect sheet bundle thickness
St12
Sheet conveying means changes sheet bundle position
St13
Convey sheet to application position
Convey sheet to cover sheet binding position
Detect cover thickness
St14
Adhesive applying process
St15
Paste container home position?
No
Yes
St16
Convey sheet bundle to binding position
St17
Cover binding process (actuate fold-back press member)
St18
Bundle conveying means ungrips sheet bundle
St19
Cooling time setting timer table
St20
Sheet bundle abuts against back abutting plate
Start cooling
St21
Elevate bundle conveying means (grip sheet trailing end)
St22
Predetermined cooling time elapsed?
No
Yes
St23
Sheet conveying means performs grip operation
St24
Convey sheet to folding roll position
St25
Rotationally drive folding roll
St26
Convey and house sheet bundle
End bookbinding process

BOOKBINDING APPARATUS AND IMAGE FORMING SYSTEM COMPRISING THE SAME

BACKGROUND OF THE INVENTION AND RELATED ART STATEMENT

The present invention relates to a bookbinding apparatus that sets sheets with images formed thereon by an image forming apparatus or the like, into a bundle, applies an adhesive to a spine part of the sheet bundle, and binds the sheet bundle to a cover sheet for bookbinding, and in particular, to a bookbinding apparatus that joins a sheet bundle with a paste applied to a spine part thereof, to a central part of a cover sheet and folds back the cover sheet so that the sheet bundle is cased in the cover sheet for bookbinding.

Bookbinding apparatuses of this kind are widely used as terminal apparatuses for image forming systems such as printers or printing machines, automatic bookbinding systems that stack sheets with images formed thereon, in order of pages, set the sheets into a bundle, apply a paste to an end surface of the bundle, and bind the bundle to a cover sheet, or bookbinding apparatuses that set print sheets supplied through a sheet feeding port and bind the set sheets to a cover sheet. In particular, in connection with on-demand printing such as electronic publishing, a recently known system simultaneously executes a printing process and a bookbinding process by printing predetermined documents while automatically binding the documents together to produce booklets.

For example, Japanese Patent Publication Laid-Open No. 2004-209869 discloses, like the system described above, an apparatus configuration that automatically binds sheets output by an image forming system, into a book. According to Japanese Patent Publication Laid-Open No. 2004-209869, the apparatus receives sheets output by the image forming system through a sheet discharging port, guides the sheets to a sheet carry-in path, and collects the sheets on a loading tray provided downstream of the path. The apparatus then swivels the sheet bundle collected on the tray in a horizontal posture through 90° and guides the bundle in a vertical posture to a pasting device for an applying process. Then, the sheet bundle with a paste applied thereto and a cover sheet supplied by the image forming system or an inserter apparatus are folded and bound together.

A conventionally known bookbinding method used for such a bookbinding system is casing-in in which a sheet bundle with a paste applied to a spine part thereof is joined to the center of a cover sheet carried in from a direction orthogonal to the sheet bundle and in which the cover sheet is then folded to form the sheets into a booklet. In this case, the cover sheet having the sheet bundle joined to the center thereof is pressed by a lateral pair of back folding blocks to form a spine part. Accordingly, the system adopts a structure in which the lateral pair of back folding blocks is shaped like a press tool and in which the back folding blocks each lying at a standby position laterally away from a central back folding position as a reference move closer to each other to fold the spine part of the cover sheet at the central back folding position.

Japanese Patent Publication Laid-Open No. 2005-104063 discloses that after a cover sheet is bound to a sheet bundle with an adhesive applied thereto, a cooling time during which the adhesive is cooled for solidification is adjusted depending on the thickness of the sheet bundle. According to Japanese Patent Publication Laid-Open No. 2005-104063, the cooling time to be adjusted corresponds to the time required to execute a bookbinding step and a subsequent cutting step.

When a hot melt adhesive is applied to the spine part of the sheet bundle, which is then joined to the cover sheet in inverse T shape, and the spine part of the cover sheet is then folded back by the press member, as described above, the following problem may occur. If the adhesive layer is unnecessarily thick, then during back folding pressing, an excess portion of the adhesive may leak from opposite shoulders (k1 and k2 in FIGS. 11 (*a*) and 11(*b*)) of the spine cover toward the back cover. This is shown in FIG. 11(*a*). The inside of the front cover of the cover sheet may be mistakenly attached to the first page of the saddle-stitched sheets (print sheets), and the inside of the back cover may be mistakenly attached to the end page of the saddle-stitched sheets. Furthermore, if the adhesive layer is unnecessarily thin, then as shown in FIG. 11(*b*), the cover sheet and the saddle-stitched sheets may disadvantageously not be bonded together at the back folding shoulders (k1 and k2), resulting in degraded bookbinding quality or missing pages.

To solve these problems, the amount of adhesive to be applied by paste applying means is adjusted depending on the thickness of the sheet bundle so as to form an appropriate adhesive layer on the bundled saddle-stitched sheets. In spite of the adjustment of the thickness of the adhesive layer, the adhesive may leak from the back folding shoulders or an insufficient amount of adhesive may be applied to the shoulders. In particular, a large amount of leaking adhesive may wrinkle the spine cover or distort back folding edges, degrading the bookbinding quality. The insufficient adhesion of the shoulders may cause a serious problem such as missing pages.

The inventor has thus found the following with respect to the leakage of the adhesive from the back folding shoulders and insufficient adhesion: in connection with the relationship between the back folding press member for embossing and a plate member backing up the cover sheet, a thicker cover sheet is likely to result in the leakage of the adhesive from the back folding shoulders and a thinner cover sheet is likely to result in the insufficient adhesion of the shoulders.

The first object of the present invention is to provide a bookbinding apparatus that, when bundled sheets are cased in a cover sheet for bookbinding, prevents the possible leakage of an adhesive from shoulders of a spine cover or possible insufficient adhesion.

The second object of the present invention is to provide a bookbinding apparatus that, when the cover sheet is folded back, prevents folds in the spine cover from being distorted or wrinkled, and an image forming system comprising the bookbinding apparatus.

SUMMARY OF THE INVENTION

To accomplish this object, the present invention adopts the following configuration. A bookbinding apparatus includes collecting means (22) on which sequentially fed sheets are collected into a bundle, a bookbinding path (P5) along which sheet bundles from the collecting means (22) are sequentially subjected to bookbinding, bundle conveying means (30) located on the bookbinding path (P5) for transferring the sheet bundle to a paste applying position (X) and then to a cover binding position (K), paste applying means (51) located at the paste applying position (X) for applying an adhesive to a spine part of the sheet bundle, a cover feeding path (P4) crossing the bookbinding path (P5) to feed a cover sheet to the cover binding position (K), cover binding means (65) located at the cover binding position (K) for binding the sheet bundle with the adhesive applied thereto, to the cover sheet, and cover binding control means (80) for controlling the cover binding means (65).

The cover binding means (65) includes back folding press members (65*a* and 65*b*) folding back the cover sheet placed on the spine part of the sheet bundle at the cover binding position so that the cover sheet is formed into covers, and a back abutting plate member (64) backing up the cover sheet. The back abutting plate member (64) is located downstream of the back folding press members so that the cover sheet is sandwiched between the back abutting plate member (64) and the spine part of the sheet bundle with a small gap (Gb) formed between the back abutting plate member (64) and the spine part. The size of the gap (Gb) between the back abutting plate member and the sheet bundle spine part at the cover binding position (K) is adjustably increased or reduced. The cover binding control means (80) adjusts the size of the gap (Gb) between the back abutting plate member (64) and the sheet bundle spine part depending on the thickness of the cover sheet when the cover sheet is folded back by the back folding press members (65*a* and 65*b*).

To adjust the size of the gap Gb between the back abutting plate member (64) and the sheet bundle spine part at the cover binding position, the cover binding control means (80) (1) adjustably increases or reduces an amount by which the bundle conveying means (40) transfers the sheet bundle to the cover binding position (K) or (2) moves a position of the back abutting plate member (64) in a vertical direction.

Cover thickness detecting means (th1) is located on the cover feeding path (P4) for detecting the thickness of the cover sheet. The cover binding control means (80) adjusts the size of the gap (Gb) between the back abutting plate member (64) and the sheet bundle spine part on the basis of detection information from the cover thickness detecting means (th1).

The cover binding control means (80) includes input means (83) via which the thickness of the cover sheet is input to the apparatus. The size of the gap (Gb) between the back abutting plate member (64) and the sheet bundle spine part is adjusted on the basis of the cover thickness information input via the input means (83).

The cover binding control means (80) sets the size of the gap (Gb) between the back abutting plate member (64) and the sheet bundle spine part at a larger value for a thicker cover sheet and at a smaller value for a thinner cover sheet.

The collecting means (22) or the bundle conveying means (30) includes bundle thickness detecting means for detecting the thickness of the sheet bundle. The paste applying means (51) adjustably increases or reduces the amount of adhesive applied to the spine part of the sheet bundle depending on the thickness of the sheet bundle detected by the bundle thickness detecting means.

The back abutting plate member (64) includes cooling means for cooling the adhesive for solidification. The cover binding control means executes a back folding process by controlling the back folding press members (65*a* and 65*b*) in a non-contact state in which the back abutting plate member (64) is separated from the cover sheet. After the back folding process, the folded cover sheet is brought into abutting contact with the back abutting plate member (64) and the adhesive is cooled for solidification.

An image forming system includes an image forming apparatus having image forming means for sequentially forming images on sheets and a bookbinding apparatus setting the sheets from the image forming means into a bundle, applying an adhesive to the bundle, and binding a cover sheet to the bundle so that the cover sheet forms covers, the bookbinding apparatus being configured as described above.

With the above configuration, when the cover sheet is subjected to back folding pressing by the back folding press member in order to case the saddle-stitched sheet bundle with the adhesive applied thereto, in the cover sheet, the distance between the end surface of the spine part of the saddle-stitched sheet bundle and the back abutting plate member, backing up the cover sheet, is controllably increased or reduced depending on the thickness of the cover sheet. This enables an adhesive layer of a predetermined thickness to be formed between the cover sheet and the spine part of the saddle-stitched sheet bundle regardless of the paper thickness. That is, the distance between the end surface of the spine part of the saddle-stitched sheet bundle and the back abutting plate member is set at a larger value for a thicker cover sheet and at a smaller value for a thinner cover sheet. This forms the predetermined gap between the cover sheet, backed up by the back abutting plate member, and the end surface of the spine part of the saddle-stitched sheets, thus forming a uniform adhesive layer.

Furthermore, the thickness of the cover sheet is automatically detected by an ultrasonic sensor, a photosensor, or the like on the cover feeding path or a user can input paper thickness information via an input panel. This enables a bookbinding process to be always achieved so as to provide a high quality finish using the relatively simple configuration. The present invention thus exerts significant effects.

The other objects and characteristics of the present invention will be clarified in the description below of embodiments based on the attached drawings.

BRIEF DESCRIPTION OF THE DRAWINGS

FIGS. 6(*b*)*a*, and 6(*b*)*b* are diagrams illustrating the gap (embossing gap) between a sheet bundle and a back abutting plate member of the cover binding means in the apparatus shown in FIG. 1, wherein FIG. 6(*b*)*a* shows that the position of the sheet bundle is adjusted depending on the paper thickness of a cover sheet, and FIG. 6(*b*)*b* shows that the position of the back abutting plate member is adjusted depending on the paper thickness;

FIG. 10 is a flowchart showing an operational procedure used by the cover binding control means of the apparatus shown in FIG. 2.

DETAILED DESCRIPTION OF THE PREFERRED EMBODIMENTS

Figure 1:
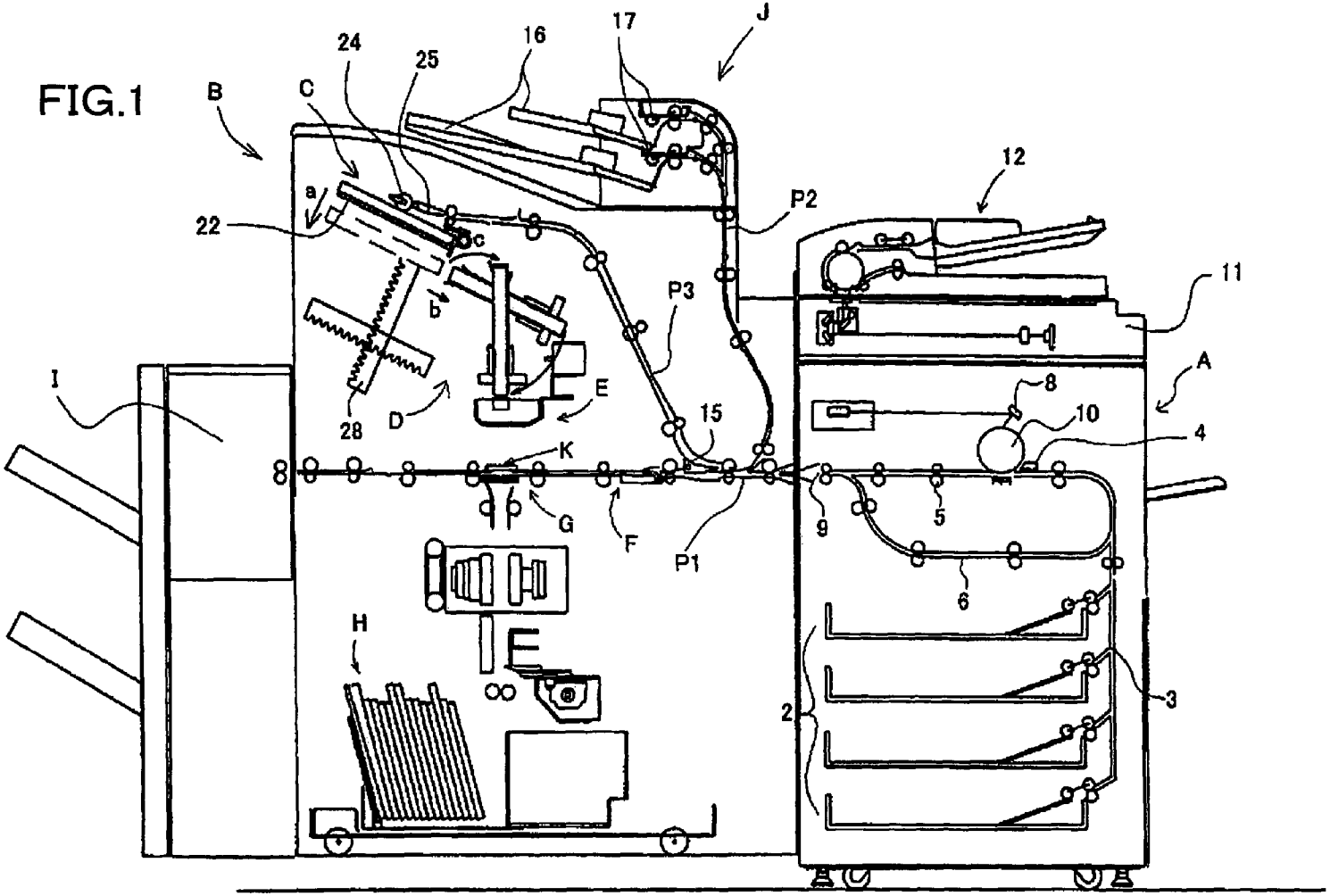
FIG. 1 is a diagram of a general configuration of an image forming system comprising a bookbinding apparatus in accordance with the present invention.
Figure 2:
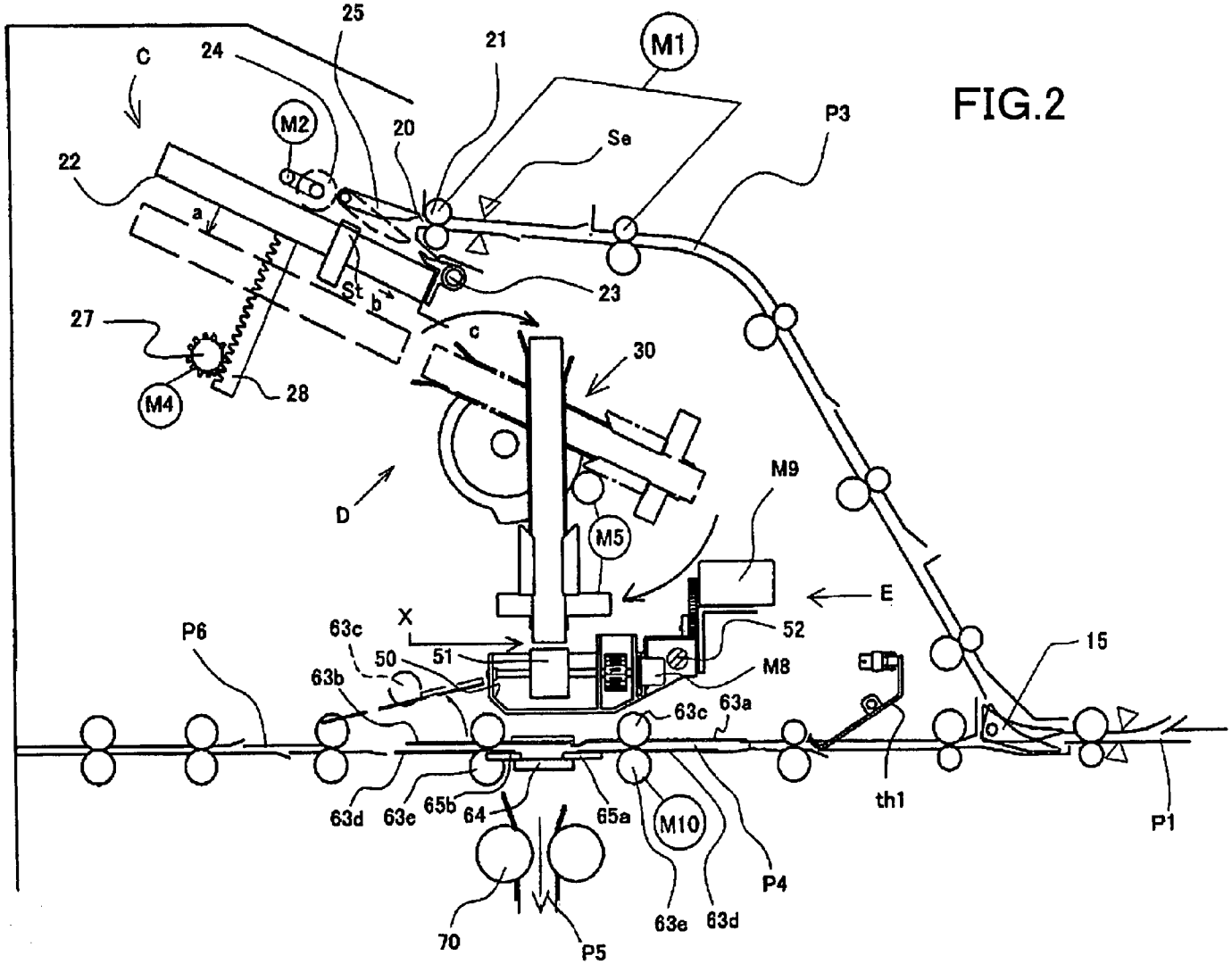
FIG. 2 is an enlarged diagram illustrating a part of the system shown in FIG. 1 corresponding to the bookbinding apparatus.

The present invention will described with reference to an illustrated preferred embodiment. FIG. 1 is a diagram illustrating a general configuration of an image forming system comprising a bookbinding apparatus in accordance with the present invention. FIG. 2 is an enlarged diagram of an essential part of the image forming system.

A bookbinding apparatus B in accordance with the present invention is coupled to, for example, an image forming system A as shown in FIG. 1. The bookbinding apparatus B receives sheets with images formed thereon from the image forming system A, sets the sheets into a bundle, applies an adhesive such as a paste to an end surface of the sheet bundle, joins a cover sheet to the sheet bundle, and subjects the cover sheet and the sheet bundle to back folding pressing for bookbinding. The cover sheet is fed in a direction orthogonal to a conveying path for the sheet bundle by means of an image forming system or an inserter apparatus. FIG. 1 shows such an image forming system. The image forming system A and the bookbinding apparatus B will be described below in this order.

The illustrated image forming system A will be described below. The image forming system A is incorporated in a system such as a computer or a word processor to print a series of documentary contents on sheets and carries the resultant sheets out through a sheet discharging port 9. As printing means, means for laser printing, inkjet printing, offset printing, or the like may be adopted. The illustrated printing means is composed of a print drum 10 such as an electrostatic drum, a sheet feeding cassette 2 that supplies sheets to the printing drum 10, a print head 8 for a laser or the like which forms an image on the print drum 10, a developing unit 4, and a fixing unit 5. Sheets of a predetermined size are fed from the sheet feeding cassette 2 to a sheet feeding path 3 on which the print drum 10 is located. The print head 8 forms an electrostatic latent image on the print drum 10. The developing unit 4 then attaches toner ink to the latent image. The toner image formed on the print drum 10 is transferred to a sheet and fixed thereto by the fixing unit 5. The resultant sheet is discharged through the sheet discharging port 9.

Reference numeral 6 in the figure denotes a duplex path along which a sheet with an image printed on one side is swiveled upside down and the upside-down sheet is guided to the print drum 10 again, where a back surface of the sheet is printed. Reference numeral 11 in the figure denotes an image reading device composed of a platen on which document sheets are set, a scanning carriage that reciprocates along the platen, and a photoelectric converting element such as a CCD which photoelectrically converts the document image scanned by the carriage. Reference numeral 12 denotes a document feeding device comprising a tray on which documents are set so as to be automatically supplied to the platen, a conveying path along which the documents are guided from the tray to the platen, and a sheet discharging tray. The document data read by the image reading device 11 is transferred to a data storage section of the print head 8. The data storage section is connected to external equipment such as a computer or a word processor to receive document data supplied by the external equipment.

The bookbinding apparatus B in accordance with the present invention is composed of "sheet collecting means C" on which sheets sequentially carried out through the sheet discharging port 9 in the image forming system A are set into a bundle by stacking the sheets in order of the pages, "bundle conveying unit D" that transfers the sheet bundle from the sheet collecting means C along a bookbinding path P5, "adhesive applying means E" located at a paste applying position X for applying an adhesive to a spine part of one end of the sheet bundle, "cover sheet conveying means F" for feeding and setting a cover sheet at a cover biding position located downstream of the paste applying means X, a "binding unit G" located at the cover binding position K to join the cover sheet and the sheet bundle together, and a "housing stack unit H" in which the finished sheet bundle is housed. These arrangements will be described below.

As shown in FIG. 1, a sheet carry-in path P1 is coupled to the sheet discharging port 9 in the image forming system A. The sheet carry-in path P1 is located substantially in a horizontal direction and composed of a path traversing the center of the apparatus. The sheet carry-in path P1 connects to a sheet feeding path P2 from an inserter apparatus J (described below) that feeds a cover sheet and to a saddle-stitched sheet conveying path P3 along which sheets from the image forming system A are conveyed. A path switching flapper 15 is provided in a path branching portion. The saddle-switched sheet conveying path P3 is located so as to guide sheets upward from the sheet carry-in path P1, located in the center of the apparatus. The saddle-stitched sheet conveying path P3 has a sheet discharging roller (sheet conveying means) 21 and a sheet sensor Se provided at a sheet discharging port 20 therein.

A collecting tray (collecting means; this will also apply to the description below) is located downstream of the sheet conveying path P3 below the sheet discharging port 20 so as to form a step. The collecting tray 22 has a sheet guide 25, an aligning roller 24, and a trailing end regulating member 23 arranged thereon; the trailing end regulating member 23 regulates the position of the sheet trailing end. The sheet guide 25 is composed of a guide member that guides a sheet from the sheet discharging port 20 onto the collecting tray 22. The aligning roller 24 transfers the sheet moved along the sheet guide 25 and onto the tray, in a sheet discharging direction (leftward in FIG. 2). After the trailing end of the sheet is placed on the tray, the sheet is switched back to the opposite direction (rightward in FIG. 2) to bring the sheet into abutting contact with the trailing end regulating member 23 for alignment. Thus, the aligning roller 24 is coupled to a reversible driving motor M2. The sheet guide 25 is configured to swing freely so as to move from the sheet discharging port 20 onto the collecting tray 22 to guide the sheet when switching back the sheet on the collecting tray 22 to align the sheet with the trailing end regulating member 23. Driving means such as an actuating solenoid (not shown) is coupled to the sheet guide 25.

The collecting tray 22 comprises aligning means (not shown) for aligning the width-direction posture of the sheet. The aligning means has, for example, a lateral pair of aligning plates arranged on the tray so as to be movable in the width direction for alignment using one side or the center as a reference. At least one of the aligning plates is reciprocated by a driving motor or the like. The collecting tray 22 may be fixed to an apparatus frame. In the figure, the collecting tray 22 is attached to the apparatus frame so as to be able to elevate and lower between a loading position and a carry-out position in the vertical direction of FIG. 1. A rack gear 28 provided on the collecting tray 22 is meshed with a pinion 27 coupled to a tray elevating and lowering motor M4 so that the tray elevating and lowering motor M4 is rotated forward and backward to elevate and lower the collecting tray 22 between the loading position (a solid line in FIG. 1) and the carry-out position (a dashed line in FIG. 1). Consequently, the sheet collected on the collecting tray 22 is lowered in the direction of an arrow a from the loading position and then transferred in the direction of an arrow b to the following bundle conveying means 30.

Bundle thickness detecting means St is located on the collecting tray 22 for sensing the thickness of the loaded sheet bundle. The sensing means St is, for example, a sly duck sensor that detects the position of a gripper gripping sheets on the collecting tray to detect the thickness of the sheet bundle on the basis of, for example, a resistance value. The bundle thickness detecting means St detects the thickness of the sheet bundle collected on the collecting tray 22 to (1) set the size of the gap between the adhesive applying roll and the sheet bundle depending on the thickness of the sheet bundle. The bundle thickness detecting means St also (2) adjusts the position at which a cover sheet is set and an amount by which the cover sheet is fed, depending on the thickness of the sheet bundle to allow the sheet bundle to align with the center of the cover sheet. The bundle thickness detecting means St further (3) adjusts the position at which the back folding press means is actuated (the standby position), depending on the thickness of the sheet bundle. The bundle thickness detecting means St is used for these subsequent processing operations. Thus, the bundle thickness detecting means St may adopt various thickness sensing methods, for example, a method of counting the number of sheets by a sheet sensor Se located at the sheet discharging port 20 to multiply the number of the sheets by the average paper thickness of the sheet.

"Bundle Conveying Unit"

Figure 3:
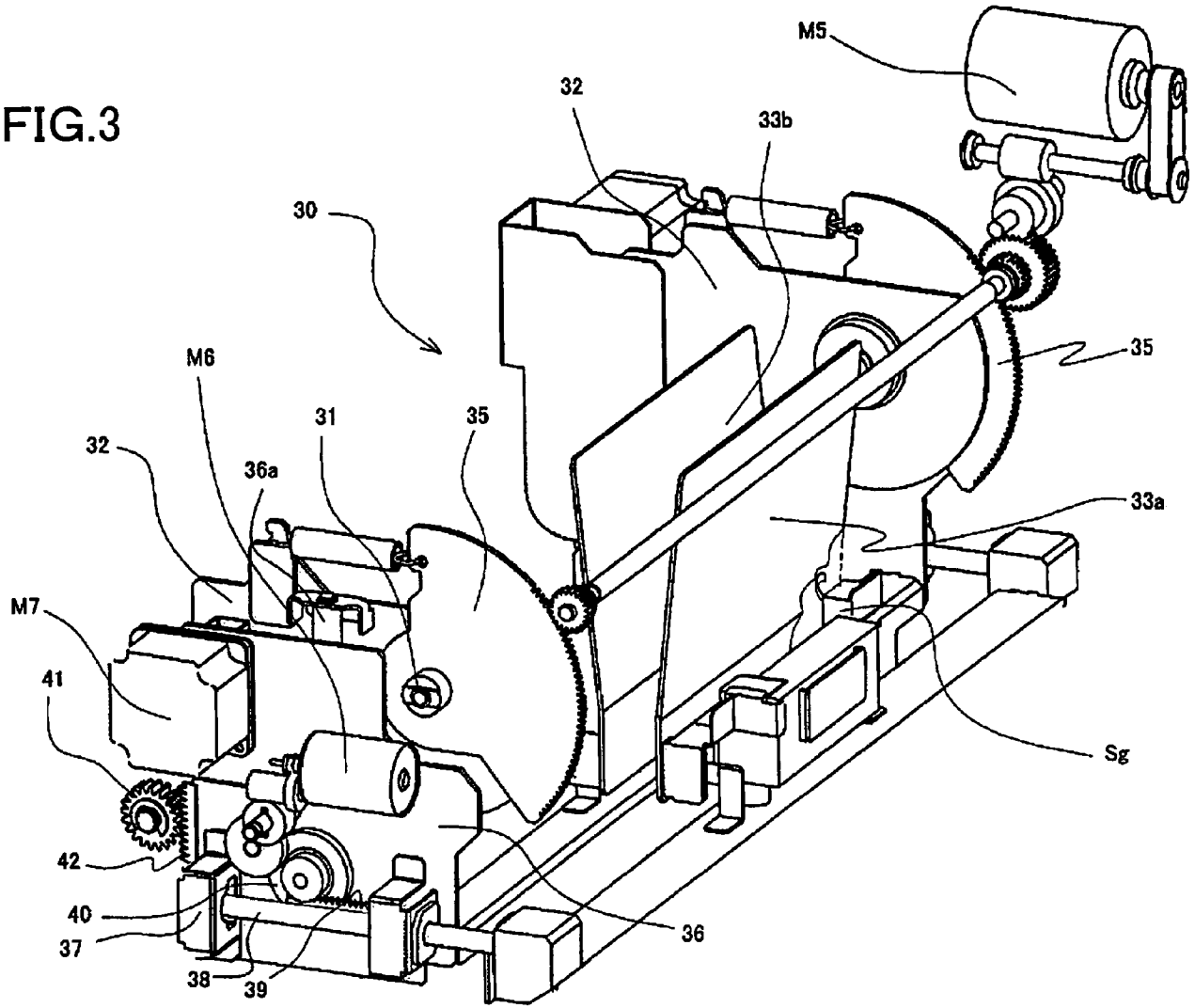
FIG. 3 is a diagram illustrating the configuration of bundle conveying means in the apparatus shown in FIG. 1.

The bundle conveying unit D conveying the sheet bundle downstream from the collecting tray 22 to the paste applying position X is composed of the bundle conveying means 30 as shown in FIG. 3. The bundle conveying means 30 is located on the bookbinding path P5, located to traverse the bookbinding apparatus B in the vertical direction, to swivel a sheet bundle in a substantially horizontal posture which has been received from the collecting tray 22, through 90° so that the sheet bundle assumes a vertical posture, and then to transfer the sheet bundle to the downstream paste applying means X. Thus, the bundle conveying means 30 is composed of a pair of clampers 33*a* and 33*b* that grips a sheet bundle and a unit frame 32 comprising both clambers 33*a* and 33*b*. The unit frame 32 is rotatably supported on the apparatus frame via a shaft 31 and is swiveled clockwise and counterclockwise in FIG. 3 by using a swiveling motor M5 provided on the apparatus frame to rotationally drive a fan-shaped gear 35 provided on the shaft 31.

A movable frame 36 is fitted on and supported by a guide rail 36*a* so as to be movable in the vertical direction; the guide rail 36*a* (partly shown in FIG. 3) is provided in the unit frame 32 pivotably supported on the apparatus frame via the shaft. A pinion 41 coupled to an elevating and lowering motor M7 provided on the unit frame 32 meshes with a rack gear 42 provided on the movable frame 36. The pair of clampers 33*a* and 33*b* is attached to the movable frame 36 as described below. The fixed clamper 33*b* is fixed to a right side frame and a left side frame constituting the movable frame 36 so that a width size sufficient to grip sheets. A rod 38 is provided on the movable clamper 33*a* and is fitted in and supported by a bearing 37 provided on the movable frame 36. A pinion of a grip motor M6 is coupled to and meshed with a rack gear 39 integrated with the rod 38.

Consequently, the clampers 33*a* and 33*b* perform a grip operation of gripping a sheet bundle by means of the grip motor M6, and swivels the gripped sheet bundle from the horizontal posture to the vertical posture by means of the swiveling motor M5. The clampers 33*a* and 33*b* then transfers the sheet bundle in the vertical posture along the bookbinding path P5 to the downstream paste applying position X by means of the elevating and lowering motor M7. Reference character Sg denotes a grip end sensor located on the movable clamper 33*a* to detect whether or not the sheet bundle is reliably gripped at a predetermined pressure. The grip motor M6 is used to move the movable clamper 33*a* in a direction in which the sheet bundle is gripped. The movable clamper 33*a* then approaches the fixed clamper 33*b* and engages the sheet bundle.

The engagement turns on the grip end sensor Sg to drive the grip motor M6 by a predetermined amount. The movable clamper 33*a* then further approaches the fixed clamper 33*b* with the sheet bundle sandwiched between the clampers 33*a* and 33*b*, while storing energy in a regenerative spring. The movable stopper 33*a* is then stopped to enable the sheet bundle to be gripped at a predetermined pressure. In this state, the elevating and lowering motor M7 is driven to move the bundle conveying means 30 downward in FIG. 2 while gripping the sheet bundle. The sheet bundle is thus transferred to the downstream paste applying position X.

"Adhesive Applying Means"

Figure 4:
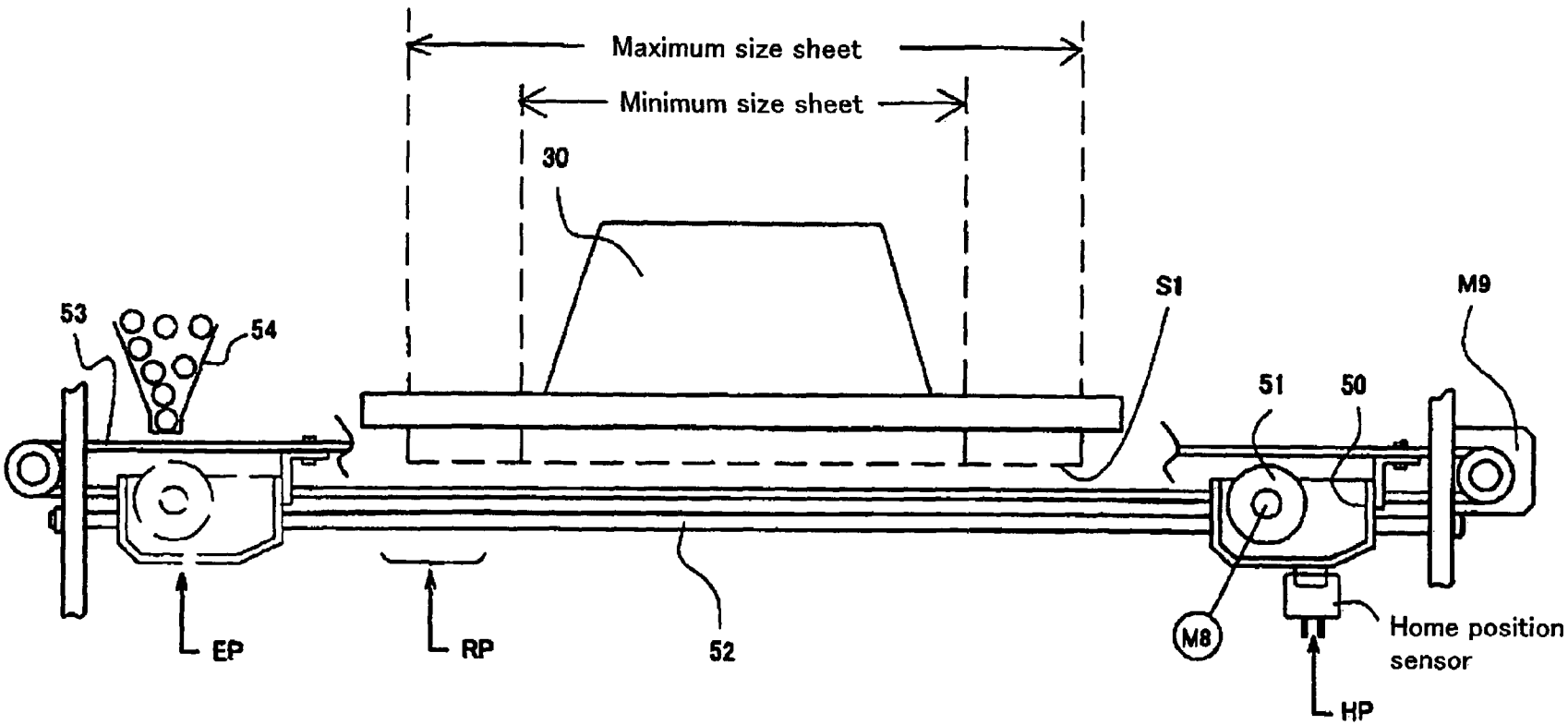
FIG. 4 is a diagram illustrating adhesive applying means in the apparatus shown in FIG. 1.
Figure 5A:
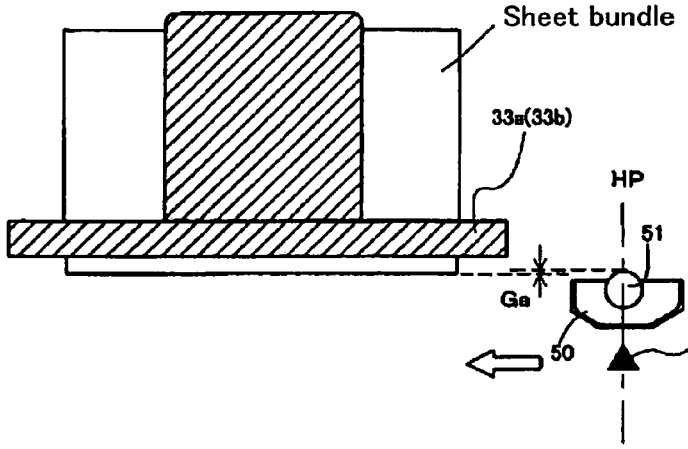
FIGS. 5(*a*), 5(*b*), 5(*c*) and 5(*d*) are diagrams illustrating how the adhesive applying means applies an adhesive, wherein FIG. 5(*a*) shows how a container moves along a going path, FIG. 5(*b*) shows how the container moves along a returning path, FIG. 5(*c*) is a side view of FIG. 5(*a*), and FIG. 5(*d*) is a side view of FIG. 5(*b*)
Figure 5C:
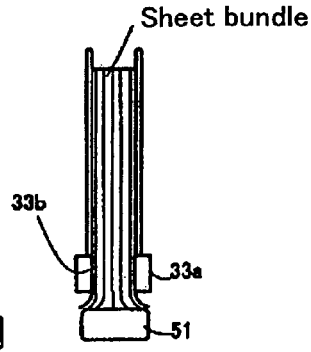
Figure 5B:
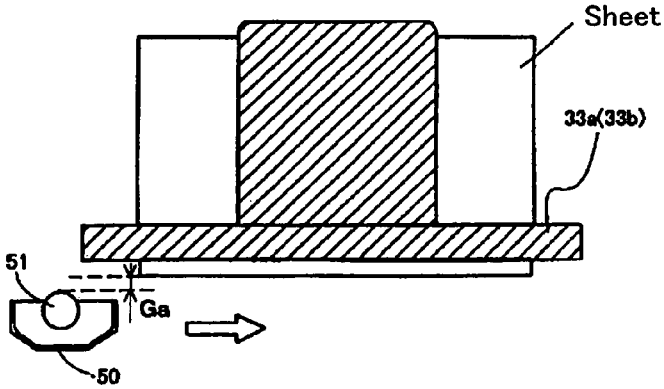
Figure 5D:
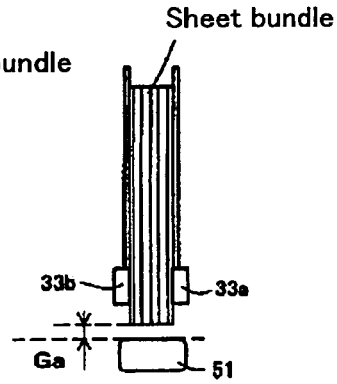

The adhesive applying means E is composed of a paste container 50 that accommodates an adhesive such as a paste, an application roll (paste applying means; this also applies to the description below) 51 rotatably mounted in the container, a driving motor M8 rotationally driving the application roll 51, and a driving motor M9 that reciprocatorily drives the paste container 50 along the sheet bundle. FIG. 4 shows a conceptual drawing of the adhesive applying means E. The paste container 50 is formed to have a shorter dimension than a lower edge of the sheet bundle (a spine cover portion of a finished book) S1. The paste container 50 is supported by a guide rail 52 (see FIG. 4) on the apparatus frame so as to move along the lower edge S1 of the sheet bundle together with the application roll 51, built in the paste container 50. The paste container 50 is coupled to a timing belt 53 which is attached to the apparatus frame and to which the driving motor M9 is coupled.

In the above-described configuration, the paste container 50 itself moves along the sheet bundle. However, the paste container 50 may be formed like a tray longer than the sheet bundle, with only the application roll 51 moved in the lateral direction of FIG. 4. The illustrated application roll 51 is composed of a porous material or silicone rubber and is impregnated with the paste so that a layer of the paste rises around the periphery of the roll.

The paste container 50 is reciprocated, by the driving motor M9, between a home position HP and a return position RP at which a returning operation along the sheet bundle is started and a refilling position EP at which the adhesive is refilled into the paste container. These positions are set in accordance with the positional relationship shown in FIG. 4. The return position RP is set on the basis of size information on the sheet width. When the apparatus is powered on (an initial state), the paste container is set at the home position HP. When a predetermined time (the expected time required for the sheet bundle to reach the paste applying position) has passed since a preceding sheet grip signal from the grip end sensor Sg of the bundle conveying means 30, the paste container moves from the home position HP to the return position RP. Simultaneously with the movement, the application roll 51 starts to be rotated by the driving motor M8. Reference numeral S7 denotes a home position sensor for the paste container 50.

The rotation of the driving motor M9 causes the paste container 50 to start moving from the right to left of FIG. 4 along the guide rail 52. On this going path, the application roll 51 comes into pressure contact with the sheet bundle to loosen the sheet ends (see FIGS. 5(*a*) and 5(*c*)). On the returning path from the return position RP to the home position HP, the application roll 51 applies the adhesive to the sheet ends with a predetermined gap Ga formed between the application roll 51 and the sheet ends (see FIGS. 5(*b*) and 5(*d*)). The amount by which the bundle conveying means 30 feeds the sheet bundle is adjusted by the elevating and lowering motor M7. The application amount is adjusted depending on the sheet bundle feeding amount so that on the basis of the bundle thickness information from the bundle thickness detecting means St, the size of the gap Ga is increased to set a greater application amount for a thicker bundle and is reduced to set a smaller application amount for a thinner bundle. Instead of thus adjustably increasing and reducing the sheet bundle feeding amount under the control of the elevating and lower motor M7 of the bundle conveying means 30, roll position adjusting means may be provided for adjusting the position of the application roll 51 in the vertical direction. Furthermore, in response to a withdrawal instruction signal, the driving motor M9 moves the application roll 51 from an operative position at which the application roll 51 applies the adhesive to the sheet bundle to a withdrawal position EP located away from the operative position. The application roll 51 receives a supply of the adhesive from an adhesive tank 54 located at the withdrawal position EP.

"Inserter Apparatus"

The sheet bundle with the paste applied thereto by the adhesive applying means is then bound to the cover sheet. Feeding of the cover sheet will be described. Sheets with images already formed thereon are sequentially carried out to the sheet discharging port 9 in the image forming system A. A sheet discharger stacker is normally provided at the sheet discharging port 9. According to the present invention, the sheet carry-in path P1 as the bookbinding apparatus B, described below, is coupled to the sheet discharging port 9. An inserter apparatus J is attached to the sheet carry-in path P1. The inserter apparatus J is composed of a stack tray 16 with one or more, in the figure, two stages on which sheets are stacked, pickup means 17 for separating each sheet from the remaining sheets on the stack tray 16, and the sheet feeding path P2 along which the sheet from the pickup means 17 is guided to the sheet carry-in path P1.

Each of the sheets set on the stack tray 16 is supplied to the sheet carry-in path P1 during the interval between operations of sequentially carrying out sheets through the sheet discharging port 9 in the image forming system A. That is, images are formed on a series of sheets, which are then carried out of the image forming system A. Then, after the final one of the series of sheets is carried out, one of the sheets on the stack tray 16 is supplied to the sheet carry-in path P1. Thus, special sheets such as cardboards or coating paper are prepared on the stack tray as cover sheets. In response to a control signal from the bookbinding apparatus B, described below, one of the sheets on the stacker tray 16 is carried into the sheet carry-in path P1. The stacker tray 16 has the two stackers so as to allow different types of cover sheets to be prepared on the stackers. A cover sheet from a selected one of the stackers is supplied to the sheet carry-in path.

"Cover Sheet Conveying Means"

In the system shown in FIG. 1, the sheet feeding path P2 in the inserter apparatus J is coupled to the sheet carry-in path P1. A cover sheet from the sheet feeding path P2 is guided to the cover feeding path P4 via a path switching flapper 15. The cover feeding path P4 crosses the bookbinding path P5 at right angles so that the cover sheet and the sheet bundle from the bookbinding path P5 are joined and bound together in inverse T form at a crossing portion (hereinafter referred to as a cover binding position K). The cover feeding path P4 is composed of upper conveying guides 63*a* and 63*b* and a lower conveying guide 63*d* located opposite and at a predetermined distance from the upper conveying guides 63*a* and 63*b* in the vertical direction. The upper conveying guides 63*a* and 63*b* include the first upper conveying guide 63*a*, located on the right side of the crossing portion (the cover binding position K) between the cover feeding path P4 and the bookbinding path P5, and the second upper conveying guide 63*b*, located on the left side of the crossing portion. The right and left conveying guides 63*a* and 63*b* are individually opened and closed.

The cover feeding path P4 has registration means for registering the cover sheet in each of the conveying direction and the direction orthogonal to the conveying direction, and cover sheet conveying means F for transferring the cover sheet registered by the registration means to the cover binding position K. The cover sheet conveying means F is composed of a pair of conveying rollers arranged on the cover feeding path P4. The pair of conveying rollers includes a driving roller 63*e* attached to the lower conveying guide 63*d* and a driven roller 63*c* attached to the upper conveying guide 63*a* or 63*b*. A driving motor M10 is coupled to the driving roller 63*e*. The upper conveying guides 63*a* and 63*b* and the driven roller 63*c* are attached to the apparatus frame via a cam lever or the like so as to be movable between a position where the guides and the roller come into pressure contact with the driving roller 63*e* and a position where the guides and the roller rise and separate from the driving roller 63*e*.

Thus, the upper conveying guides 63*a* and 63*b* and the driven roller 63*c* are configured to be movable between an operative position where the guides 63*a* and 63*b* and the roller 63*c* are brought, by a driving motor for a cam lever (not shown), into pressure contact with the cover sheet on the cover feeding path to transfer the cover sheet leftward in FIG. 2 and a withdrawal position where the guides 63*a* and 63*b* and the roller 63*c* rise and separate from the cover sheet. The cover sheet is thus transferred to the cover binding position K, the intersecting point between the cover feeding path P4 and the bookbinding path P5, where the cover sheet is set at a predetermined position. The upper conveying guides 63*a* and 63*b*, arranged at the cover binding position K, are composed of opening and closing guide plates and configured to be movable between a position where the guides 63*a* and 63*b* block the bookbinding path P5 and guide the upper part of the cover sheet and a withdrawal position where the guides 63*a* and 63*b* withdraw from the bookbinding path P5. After guiding the cover sheet, the second upper conveying guide 63*b* withdraw upward so as to open the bookbinding path P5 as shown in FIG. 2.

"Configuration of the Cover Binding Means"

As described above, on the bookbinding path P5, the adhesive applying means E applies a paste to the lower edge S1 of the sheet bundle gripped by the bundle conveying means 30. The paste container 50 withdraws to the home position HP, located outside the bookbinding path P5. The bundle conveying means 30 transfers the sheet bundle from the paste application position X to the cover binding position K along the bookbinding path P5. At the same time, on the cover feeding path P4, the cover sheet is fed to the cover binding position K, where the cover sheet is brought to rest and set. The cover binding means 65 is provided at the cover binding position K. The cover binding means 65 joins the sheet bundle from the bookbinding path P5 and the cover sheet from the cover feeding path P4 together in inverse T form. The spine part (spine cover) of the joint is then pressed. The bookbinding path P5 thus has the back abutting plate member 64 that backs up the cover sheet. The cover sheet supported by the back abutting plate member 64 and the spine part (paste application end) of the sheet bundle are joined together in inverse T form. The back folding press members 65*a* and 65*b* are provided, which fold back the resultant cover sheet. The back abutting plate member 64 and the back folding press members 65*a* and 65*b* constitute the cover binding means. The back abutting member 64 and the back folding press members 65*a* and 65*b* will be described below in this order.

"Configuration of the Back Abutting Member"

Figure 6A:
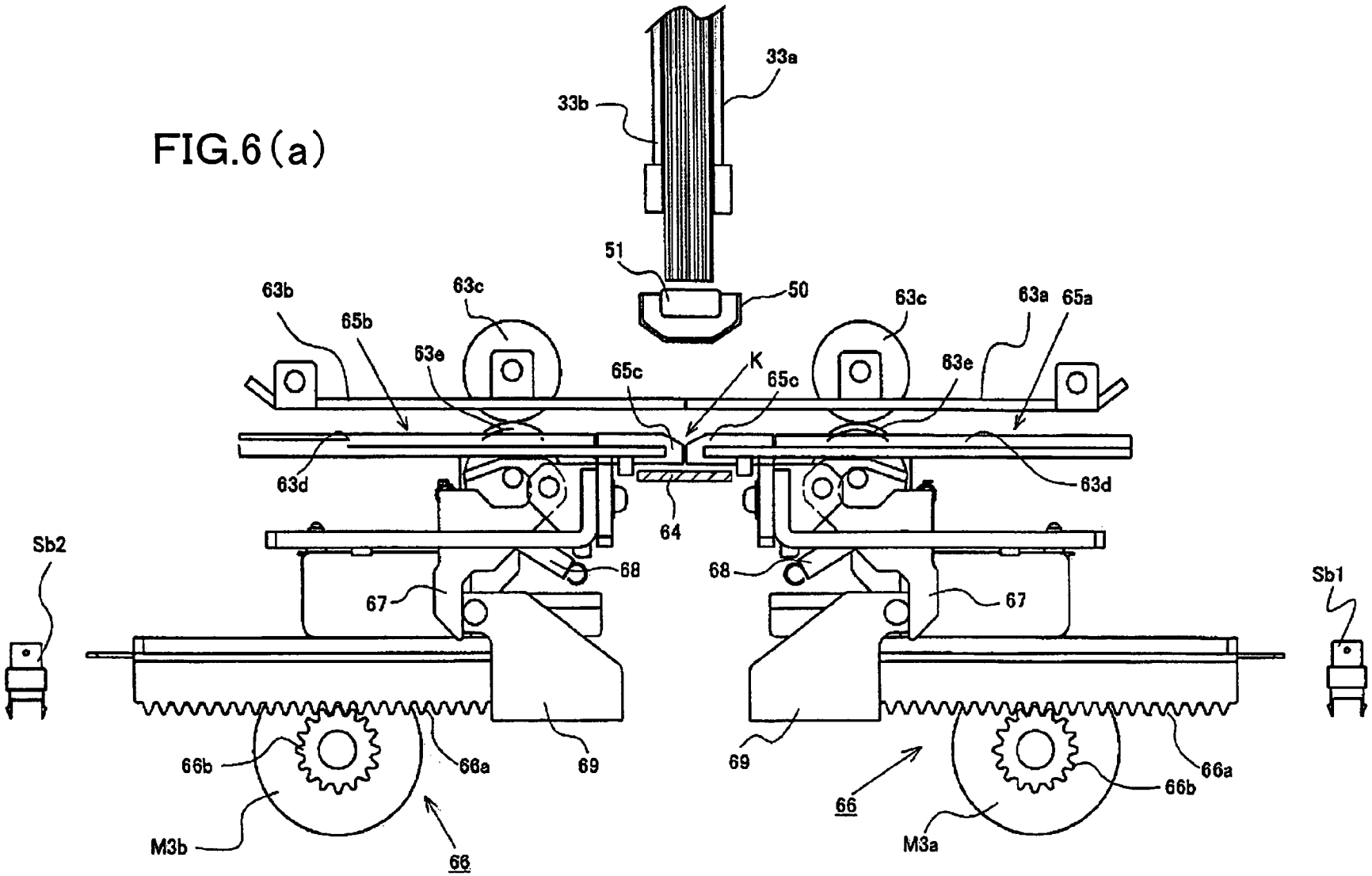
FIG. 6(*a*) is a diagram illustrating cover binding means in the apparatus shown in FIG. 1 and showing that a bookbinding path is closed.

As shown in FIG. 6(*a*), the shutter blade-like back abutting plate member 64 is located at the cover binding position K to block the bookbinding path P5. The back abutting plate member 64 is located at the cover binding position K and immediately below (downstream of) the back folding press members 65*a* and 65*b* and cooperates with the back folding press members 65*a* and 65*b* in subjecting the cover sheet to back folding pressing. The back abutting member 64 is composed of a plate-like member, and the predetermined gap Gb (hereinafter referred to as the "embossing gap") is formed between the back abutting plate member 64 and the end surface (adhesion surface) of the spine part of the sheet bundle. That is, when the size of the embossing gap Gb is "0" (zero), all of the adhesive applied to the adhesion surface of the sheet bundle leaks sideward (as shown in FIG. 13(*a*)). Furthermore, when the embossing gap Gb is unnecessarily large, a void is formed between the spine cover and the sheet bundle, resulting in incomplete adhesion (as shown in FIG. 13(*b*)).

Thus, the embossing gap GB needs to be set in an optimum condition. Theoretically, the size of the embossing gap Gb=[(the thickness of the adhesive layer)+(the thickness of the cover sheet)−(the optimum adhesion thickness)]. The optimum adhesion thickness is preferably experimentally determined on the basis of bookbinding quality including the reliable bonding between the cover sheet and the sheet bundle cased in the cover sheet, the spine cover free from wrinkles or recesses or protrusions, and the prevention of the leakage of the adhesive from the back folding shoulders. The present invention is characterized by, in this case, adjustably increasing or reducing the size of the embossing gap Gb depending on the thickness of the cover sheet.

Thus, the cover binding control means (control CPU) 80, described below, is configured to (1) adjust the conveying amount by which the sheet bundle is transferred to the cover binding position K by the bundle conveying means 30 or to (2) move the position of the back abutting plate 64 in the vertical direction. The gap adjusting mechanism (1) adjusts the amount by which the sheet bundle conveyed from the paste applying position X to the cover binding position K is transferred. This is achieved by the control CPU 80 by adjusting the conveying amount of the elevating and lowering motor M7 of the bundle conveying means 30. In the figures, the elevating and lowering motor M7 is a stepping motor, so that the number of power pulses supplied to the motor varies depending on the thickness of the cover sheet. FIG. 6(*b*)*a* shows how the amount by which the sheet bundle is conveyed is varied. In conveying the sheet bundle from the paste application position X to the cover binding position K, on the basis of cover sheet thickness information (how to acquire the information will be described below), the control CPU 80 uses a conveying amount Lx1 to form an embossing gap Gb1 for a thicker sheet, uses a conveying amount Lx2 to form an embossing gap Gb2 for a standard thickness, and uses a conveying amount Lx3 to form an embossing gap Gb3 for a thinner sheet. This sets the gap gy (hereinafter referred to as the "adhesion gap") between the cover sheet and the adhesion surface of the sheet bundle at a specified value regardless of the thickness of the cover sheet. This in turn prevents the possible leakage of the adhesive or possible insufficient adhesion resulting from the pressing by the back folding press members 65*a* and 65*b*, described below.

The mechanism adjusting the vertical position of the back abutting plate member 64 in (2), described above, comprises the back abutting plate member 64 located so as to be movable in the vertical direction along the bookbinding path P5 as shown in FIG. 6(*b*)*b*. The back abutting plate member 64 is configured to be able to elevate and lower by means of an eccentric cam 64*x*. The back abutting plate member 64 thus moves in the vertical direction depending on the paper thickness of the cover sheet. This sets the adhesion gap gy between the cover sheet and the adhesion surface of the sheet bundle at the specified value.

The back abutting plate member 64 is located so as to be movable between the operative position where the back abutting plate member 64 is positioned on the bookbinding path P5 and the withdrawal position where the back abutting plate member 64 withdraws from the bookbinding path P5. The back abutting plate member 64 can be moved forward and backward by driving means (an electromagnetic solenoid; not shown). The back abutting plate member 64 is formed of a metal plate having a high thermal conductivity and exerting a high radiating effect. the back abutting plate member 64 thus cools the adhesive (in the figure, the hot melt adhesive) applied to the sheet bundle.

"Configuration of the Cover Thickness Detecting Means"

The paper thickness of the cover sheet needs to be detected in order to set the embossing gap Gb at a specified value. The paper thickness is sensed (1) by cover thickness detecting means th1 in the cover sheet conveying path or (2) on the basis of information input via the input means such as a control panel. The mechanism (1) comprises a sensor on the cover feeding path P4. The sensor is composed of an ultrasonic sensor or a photosensor that detects the thickness of the cover sheet passing through the cover feeding path P4. For example, with the ultrasonic sensor, the thickness is detected on the basis of the amount of attenuation of an ultrasonic wave passing through the sheet. With the photosensor, an actuator engaging the cover sheet is provided on the cover feeding path P4 so that the paper thickness is sensed on the basis if the movement of the actuator.

The mechanism (2) comprises a control panel 81 in control means 79. A user (an operator) inputs the thickness of the cover sheet via the input means 83, composed of the panel. In this case, one of several levels such as "thick sheet", "standard sheet", and "thin sheet" is preferably selectively input in order facilitate the input operation. Furthermore, on the basis of these levels, a large level, an intermediate level, and a small level are pre-specified for the amount by which the sheet bundle is fed to the cover binding position K.

"Movement of the Position of the Back Abutting Plate Member"

Thus, the back folding press members 65*a* and 65*b* are arranged upstream of the back abutting plate member 64 with the small gap Gb maintained between the back abutting plate member 64 and the back folding press members 65*a* and 65*b*; the back folding press members 65*a* and 65*b* fold back the sheet bundle and the cover sheet joined together in inverse T form. As shown in FIGS. 6(*a*) and 7, the press member is composed of the lateral pair of press members 65*a* and 65*b*, each having shift means 66 that reciprocates between a back folding position (shown in FIG. 6(*a*)) and a standby position (shown in FIG. 7). The right press member 65*a* and the left press member 65*b* are slidably supported by the apparatus frame (not shown) and each have a press piece 65*c* at a leading end thereof. The spine part of the cover sheet is folded by the right and left press pieces 65*c*.

Thus, the pair of back folding press members 65*a* and 65*b* is integrated with a rack gear 66*a* that meshes with a pinion 66*b* coupled to shift motors M3*a* and M3*b*. The shift motors are composed of stepping motors. Reference numerals Sb1 and Sb2 in the figure denotes home position sensors that detect flags provided on the back folding press members 65*a* and 65*b*, respectively. Thus, the shift means 66 is composed of the shift motors M3*a* and M3*b* and transmission means for the motors M3*a* and M3*b* (the pinion 66*b* and the rack gear 66*a*).

Figure 7:
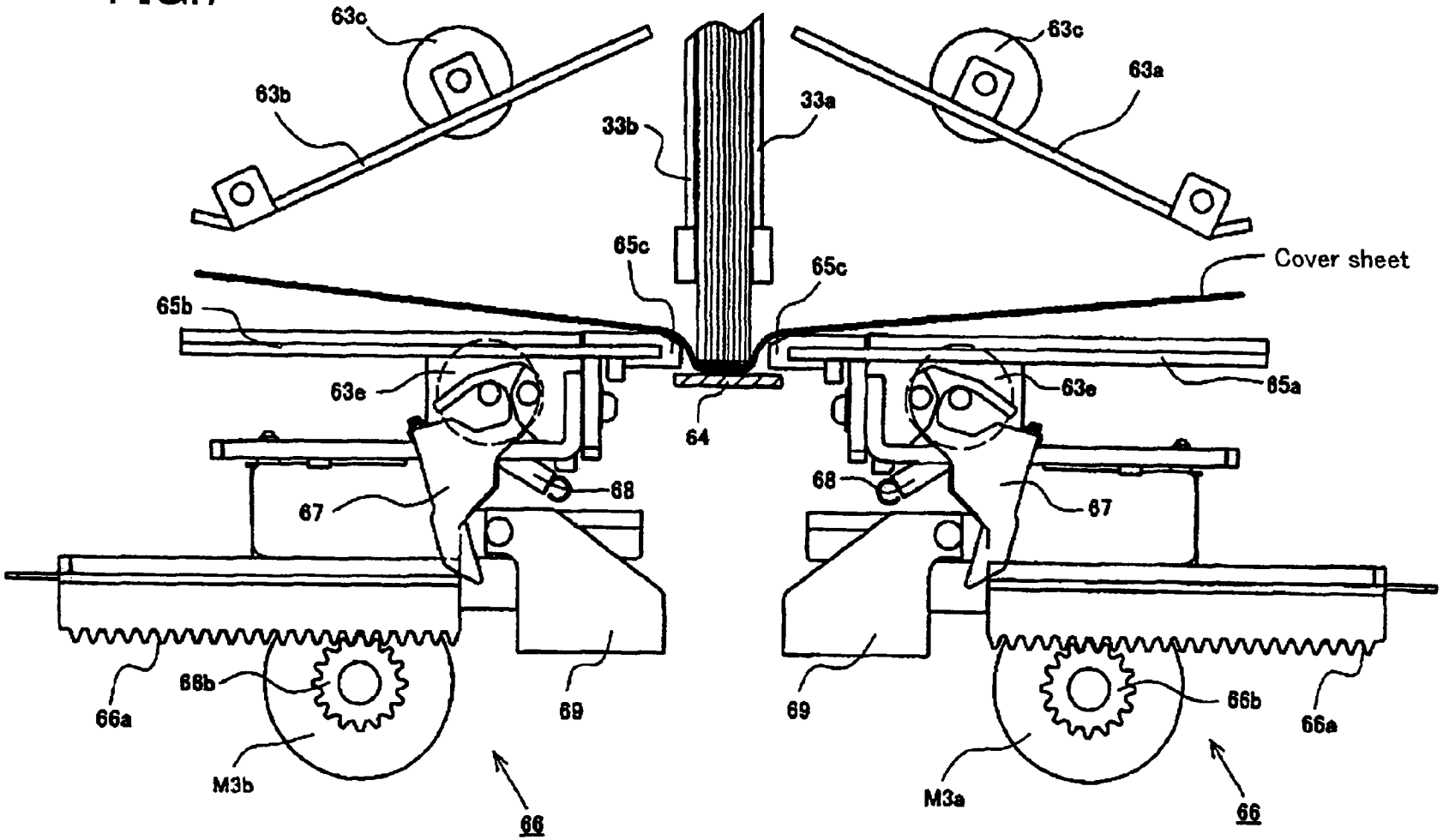
FIG. 7 is a diagram illustrating the cover binding means in the apparatus shown in FIG. 1 and showing that the bookbinding path is open.
Figure 8A:
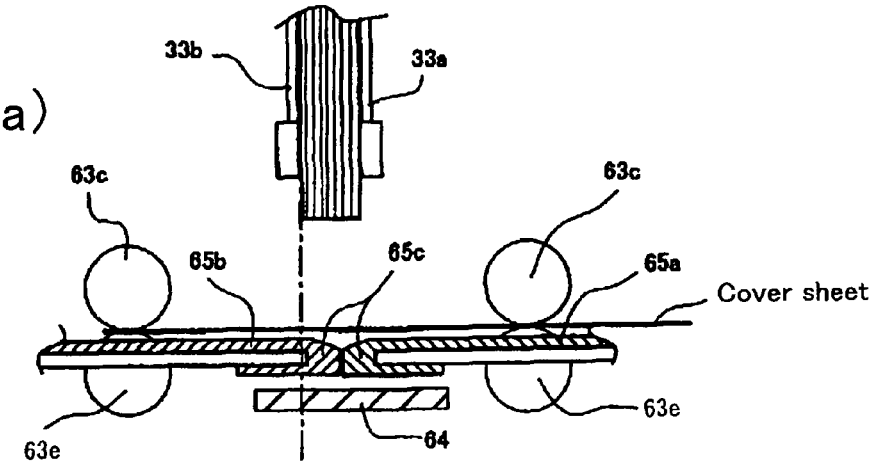
FIGS. 8(*a*)-8(*i*) are diagrams illustrating the operation of a cover binding procedure used for the apparatus shown in FIG. 2, wherein FIGS. 8(*a*), 8(*b*), and 8(*c*) show how the back folding member moves from a home position to a standby position, FIGS. 8(*d*) to 8(*f*) show how the back folding member moves from the standby position to a back folding position, and FIGS. 8(*g*) to 8(*i*) show a state observed after the back folding member has moved to the back folding position.
Figure 8B:
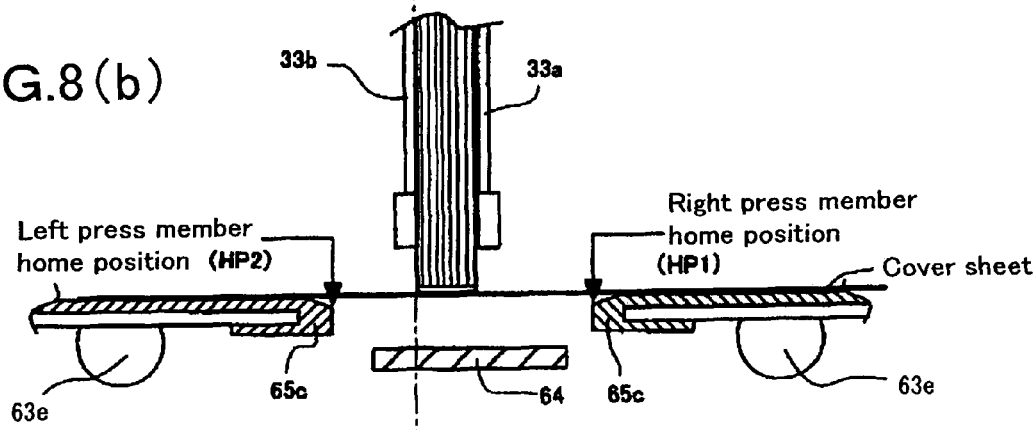
Figure 8C:
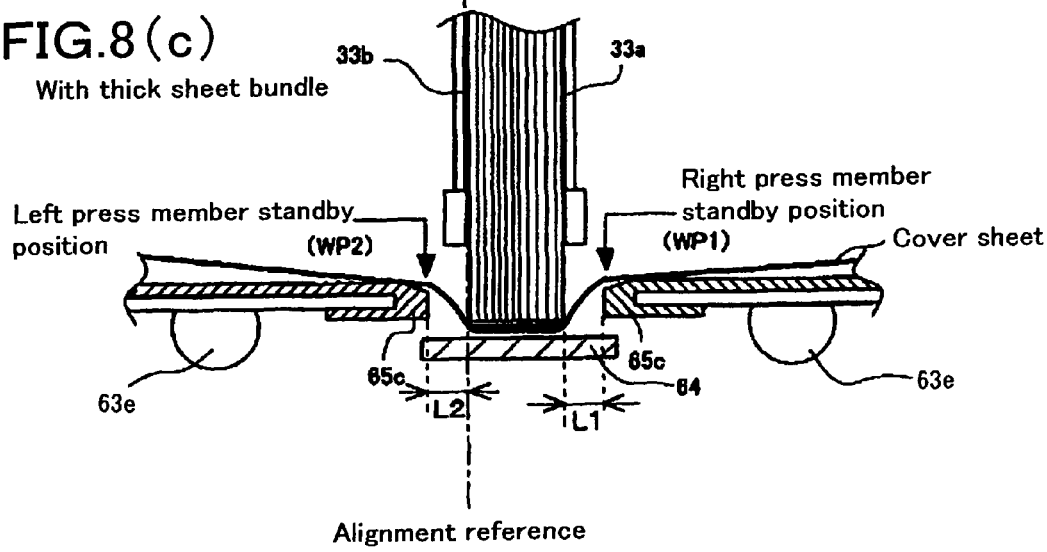
Figure 8D:
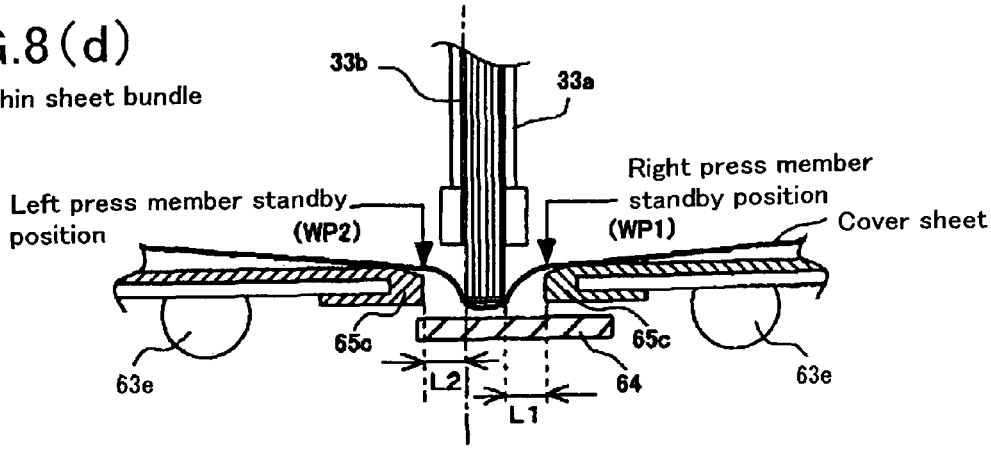
Figure 8E:
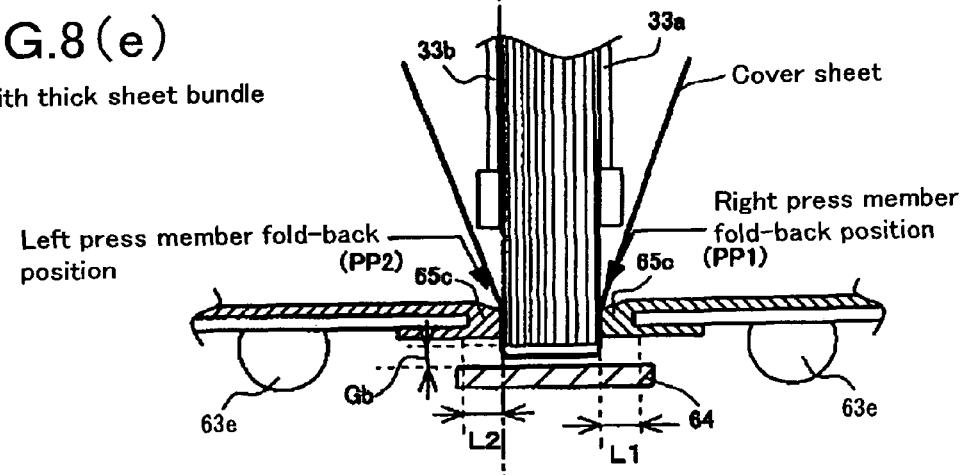
Figure 8F:
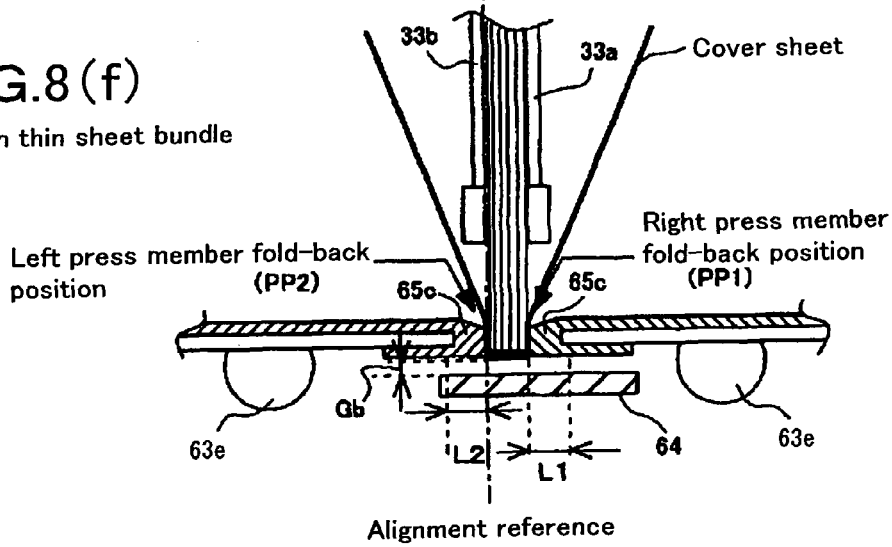
Figure 8G:
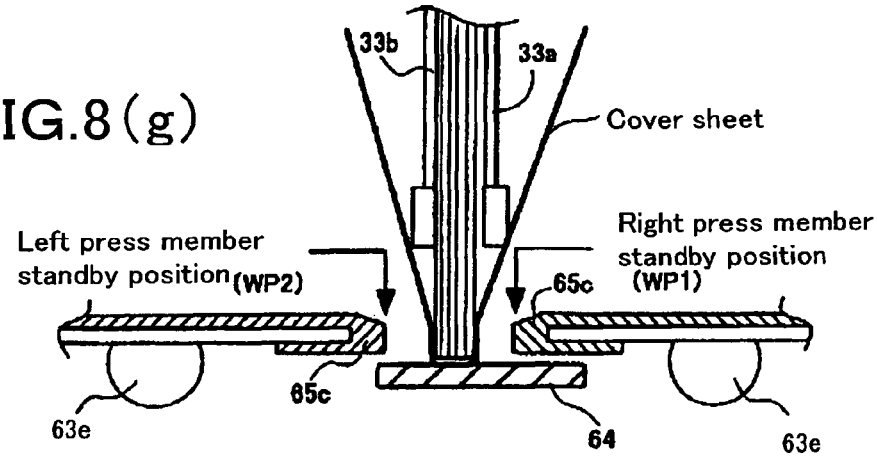
Figure 8H:
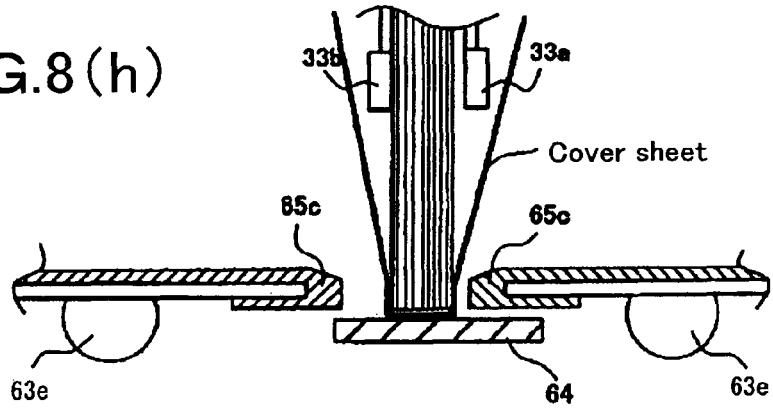
Figure 8I:
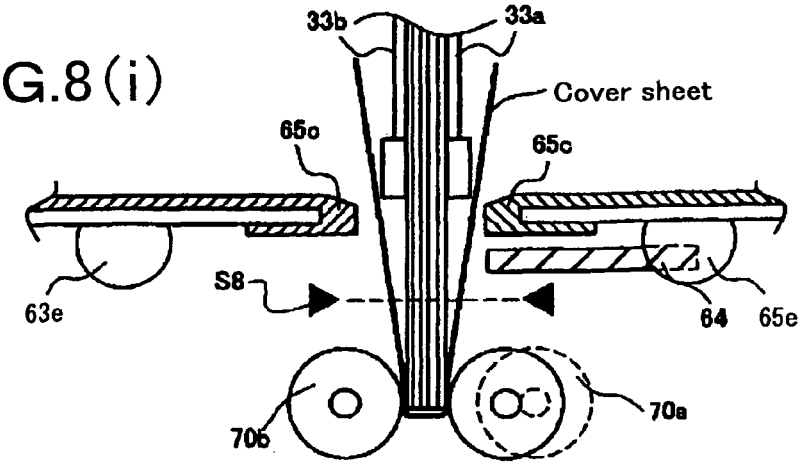

Each of the back folding press members 65*a* and 65*b* has a guide surface (the above-described lower conveying guide; this also applies to the description below) on which the cover sheet conveyed along the cover feeding path P4 is guided. Thus, each of the back folding press members 65*a* and 65*b* comprises not only the press piece 65*c*, provided at the leading end thereof, but also the guide surface 63*d*, having a top surface lying opposite the cover feeding path P4 and on which the cover sheet is guided. The guide surface 63*d* has a pinch roller (the above-described driving roller; this also applies to the description below) 63*e* which, while the back folding press members 65*a* and 65*b* are closing the bookbinding path P5 at the back folding position, cooperates with the guide surface 63*d* in guiding the cover sheet traversing the path and which sinks below the guide surface 63*d* as shown in FIG. 7 in order to withdraw to the standby position outside the path. Thus, an actuating lever 67 engages the pinch roller 63*e*, which is biased by a bias spring (not shown) so as to always project from the guide surface, so as to sink the roller below the guide surface 63*d* against the force of the bias spring. The actuating lever 67 is pulled by a spring 68 that exerts a stronger force than the bias spring, so as to pivot counterclockwise in the figure. The apparatus frame has an abutting stopper 69 that rotates the actuating lever 67 clockwise at the back folding position.

Thus, when the back folding press members 65*a* and 65*b* are at the back folding position (as shown in FIG. 6(*a*)), the pinch roller 63*e* is projected upward from the guide surface 63*d* by the bias spring. When the back folding press members 65*a* and 65*b* move away from the back folding position toward the standby position, the pinch roller 63*e* is sunk below the guide surface 63*d* by the spring 68. In this manner, at the back folding position, to which the cover sheet is conveyed, the pinch roller 63*e* projects from the guide surface 63*d* to allow the sheet to move smoothly. When the back folding press members 65*a* and 65*b* are moved to the standby position in order to fold back the cover sheet, the pinch roller 63*e* sinks below the guide surface 63*d* so as to prevent the cover sheet set at the cover binding position from being inadvertently moved.

"Control of the Back Folding Press Members"

The back folding press members 65*a* and 65*b* configured as described above are controlled as follows. The back folding press portions 65*a* and 65*b* are controlled so as to lie at the back folding position (FIG. 8(*a*)) when the cover sheet is to be fed from the cover feeding path P4 to the cover binding position K and to lie at the home position (FIG. 8(*b*)) when the sheet bundle from the bookbinding path P5 is to be joined to the cover sheet. The back folding press members 65*a* and 65*b* then move from the home position to the standby position and waits for the completion of the operation of joining the sheet bundle and the cover sheet (FIGS. 8(*c*) and 8(*d*)). Then, with the sheet bundle and the cover sheet joined together, the back folding press members 65*a* and 65*b* move from the standby position to the back folding position (see FIGS. 8(*e*) and 8(*f*)), while pressing the spine part of the sheet bundle. The cover binding control means (control CPU described below) 80 comprises at least one of (1) means for varying the standby position for the back folding press members 65*a* and 65*b* depending on the thickness of the sheet bundle, (2) means for varying an operation start timing at which the back folding press members 65*a* and 65*b* move from the standby position to the back folding position, and (3) means for varying a moving speed at which the back folding press members 65*a* and 65*b* move from the standby position to the back folding position.

The control means in (1) will be described. As shown in FIG. 8(*b*), the lateral pair of back folding press members 65*a* and 65*b* reciprocates between the home position HP1 (HP2) and the standby position WP1 (WP2) and the back folding position PP1 (PP2). The sheet bundle is fed along the bookbinding path P5 to the cover binding position K in a position and posture varying depending on the thickness of the bundle, by means of the movable clamper 33*a* and the fixed clamper 33*b*, serving as a reference; the movable clamper 33*a* and the fixed clamper 33*b* constitute the bundle conveying means 30. The distance L2 between the standby position WP2 and the back folding position PP2 for the left back folding press member 65*b* is fixed regardless of the thickness of the sheet bundle.

On the other hand, the standby position WP1 of the right back folding press member 65*a* is set to vary depending on the thickness of the sheet bundle. The distance L1 between the standby position WP1 and the back folding position PP1 is set substantially equal to the distance L2. In the adhesive applying step, the cover binding control means (control CPU) 80, described below, moves the lateral pair of back folding press members 65*a* and 65*b* from the home positions HP1 and HP2 to the standby positions WP1 and WP2, respectively, for example, in response to a timing signal indicating that the application roll 51 has reached the return position RP. At this time, in moving the right back folding press member 65*a*, the cover binding control means (control CPU) 80 varies the driving step count of the shift motor M3*a* on the basis of thickness information from the above-described bundle thickness detecting means St to set the distance (L1) between the standby position WP1 and the back folding position PP1 at a specified value.

By thus varying the standby position WP1 for the back folding press member 65*a* depending on the thickness of the sheet bundle, the back folding operation can be performed in a specified actuation time regardless of the varying bundle thickness. Thus, the control means can prevent a possible situation in which setting a fixed standby position for the back folding press members 65*a* and 65*b* results in a shorter operation time for a thicker sheet bundle and a longer operation time for a thinner sheet bundle, varying the condition of solidification of the adhesive depending on the thickness of the sheet bundle.

The cover binding control means (control CPU) 80, which controls the above-described shift motors M3*a* and M3*b*, is further configured as follows. The cover binding control means (control CPU) 80 controllably moves the back folding press members 65*a* and 65*b* from the standby position WP1 (WP2) to the back folding position PP1 (PP2), and after the cover sheet is folded back by the means 65*a* and 65*b*, returns the back folding press means 65*a* and 65*b* to the standby position WP1 (WP2). At this time, the cover binding control means (control CPU) 80 maintains the pressing condition for a predetermined holding time (hereinafter referred to as a press time) with the cover sheet pressed by the back folding press members 65*a* and 65*b* (the back folding position). After the set press time has elapsed, the cover binding control means 80 returns the back folding press means 65*a* and 65*b* to the standby position WP1 (WP2).

At this time, the cover binding control means (control CPU) 80 adjustably increases or reduces the press time depending on the basis weight and/or material of the cover sheet and/or the thickness of the sheet bundle. As described below, the cover binding control means (control CPU) 80 comprises the control panel 81, having the input means 83 via which information such as the basis weight or material of the cover sheet is input. The control CPU 80 performs the back folding operation on the basis of the press time set on the basis of the input information. Furthermore, the press time is varied depending on the thickness of the sheet bundle. In this case, the press time is set longer when the cover sheet has a heavier basis weight or is composed of a more rigid material or when the sheet bundle has a greater thickness.

Figure 9:
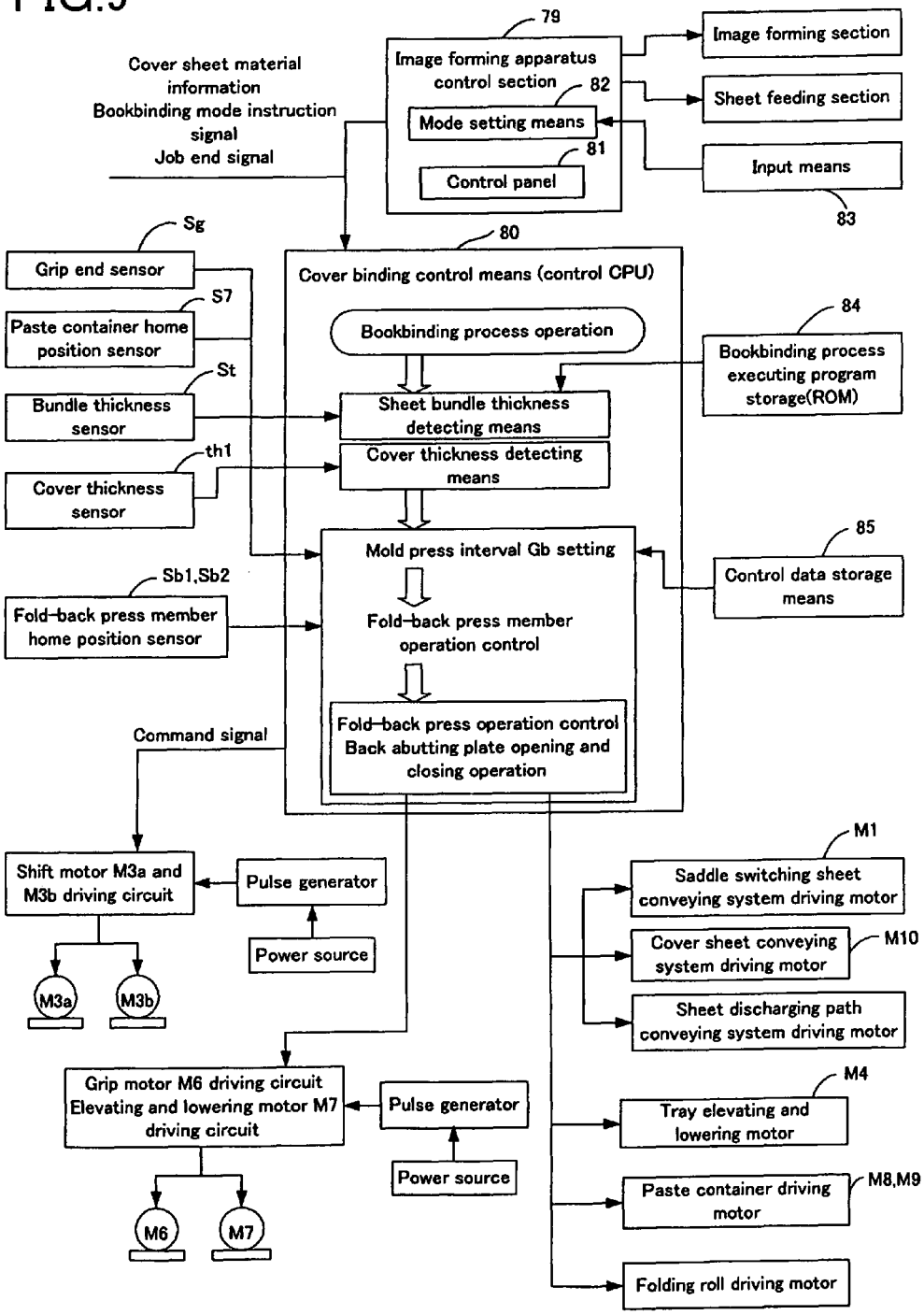
FIG. 9 is a block diagram showing the configuration of cover blocking control means of the apparatus shown in FIG. 2.
Figure 11A:
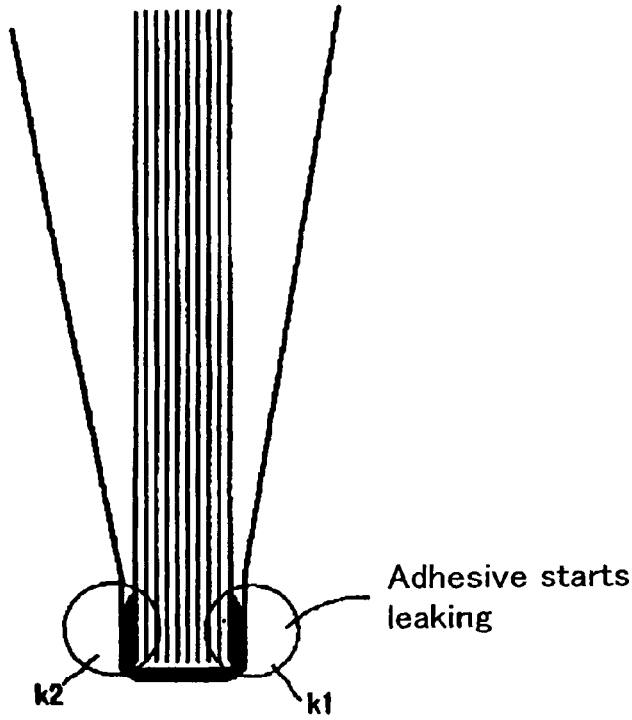
FIG.11(a) Prior Art
FIGS. 11(*a*) and 11(*b*) are diagram illustrating a conventional bookbinding finish state, wherein FIG. 11(*a*) shows that an adhesive is leaking sideward from shoulders, and FIG. 11(*b*) shows that the shoulders are incompletely bonded.
Figure 11B:
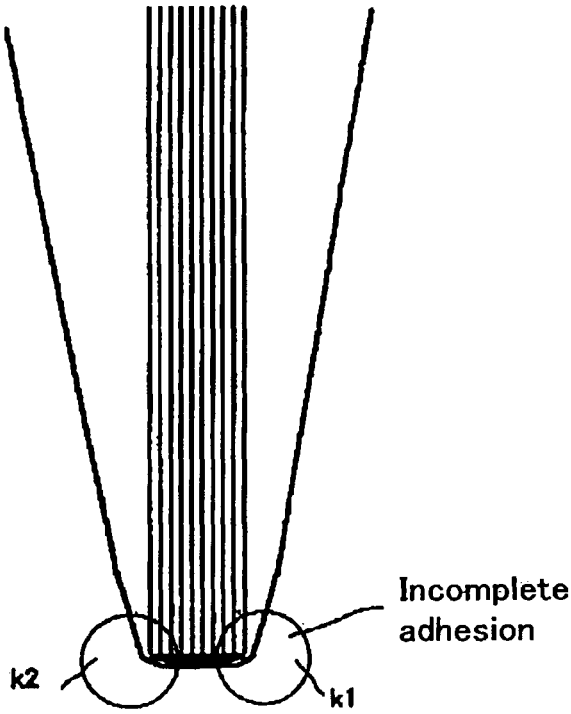
FIG.11(b) Prior Art

The configuration of the cover binding control means (control CPU) 80 will be described with reference to the block diagram in FIG. 9. In the system comprising the image forming system A and the bookbinding apparatus B coupled together as shown in FIG. 1, for example, the control section (control CPU) 79 of the image forming system A has the control panel 81 and mode setting means 82. The control CPU 79 in the image forming system A allows the bookbinding apparatus B to perform the bookbinding operation, for example, in accordance with a "print process mode" or a "bookbinding process mode" set by the control panel 81. In the print process mode, the bookbinding apparatus B conveys the print sheets carried into the sheet carry-in path P1, through the cover feeding path P4 and sheet discharging path P6, shown in FIG. 2, to a post-process device I by means of the path switching flapper 15. The print sheets are then housed in a stacker provided in the post-process device I. Consequently, the print sheets pass only through the bookbinding apparatus B.

Selection of the bookbinding process mode allows the bookbinding apparatus B to guide the print sheets from the sheet carry-in path P1 to the saddle-stitched sheet conveying path P3. The print sheets are then subjected to a sheet collecting process, a paste applying process, and a cover sheet binding process, and the finished sheets are housed in a housing stack unit H. Thus, selection of the bookbinding mode allows the control means (control CPU) 79 of the image forming system A to simultaneously transmit an instruction signal for the bookbinding mode and thickness information such as the basis weight of the cover sheet to the bookbinding apparatus B. At this time, the thickness information such as the basis weight of the cover sheet and material information indicating whether the paper material of the cover sheet is, for example, hard or soft are input via the input means 83 and transmitted to the cover binding control means (hereinafter referred to as the control CPU) 80 of the bookbinding apparatus B. Furthermore, copy count information is transferred to the control CPU 80 of the bookbinding apparatus B; if n pages are printed and when printing of the final nth page is finished, a job end signal is transferred to the control CPU 80.

The control CPU 80 is composed of a bookbinding control section and an inserter control section. The control CPU 80 connects to a conveying system driver circuit for the driving motor for the conveying roller on the sheet carry-in path P1, the driving motor M1 for the sheet discharging roller 21 on the saddle-stitched sheet conveying path P3, and the driving motor M10 for the driving roller 63*e* on the cover feeding path P4. The control CPU 80 similarly connects to a driving circuit for the tray elevating and lowering motor M4, which elevates and lowers the collecting tray 22, and the grip motor M6 and elevating and lowering motor M7 of the bundle conveying means 30. The control CPU 80 also connects to the driving motor M8 for the application roll 51, the driving motor M9, which reciprocates the paste container 50, and the shift motors M3*a* and M3*b* for the back folding press members 65*a* and 65*b*. The grip motor M6, the elevating and lowering motor M7, and the shift motors M3*a* and M3*b* are each composed of a stepping motor. Command signals from the control CPU 80 instruct the motors on the number of steps, the speed, and the like. That is, the circuits are configured such that the command CPU 80 issues command signals for pulse power source pulse count, duty, driving start timing, and driving end timing to a power pulse generator for each motor.

The circuits are also configured such that the control CPU 80 receives a sensing signal from the bundle thickness detecting means St, sensing signals from the grip end sensor Sg, the home position sensor S7 for the paste container 50, the home position sensors Sb1 and Sb2 for the back folding press members 65*a* and 65*b*, and detection signals from the sheet sensors arranged on the paths P1 to P6. The control CPU 80 comprises storage means (ROM) 84 for control programs performing the "operation of collecting saddle-stitched sheets on the collecting tray 22", the "operation of allowing the bundle conveying means 30 to transfer the sheet bundle from the collecting tray 22 to the paste applying position X and then to the cover binding position K", the "operation of applying the adhesive at the paste applying position", the "operation of joining the sheet bundle and the cover sheet together at the cover binding position K", the "back folding press operation of folding the cover sheet after the junction", and the "operation of carrying out the folded-back sheet bundle". The control CPU 80 also comprises storage means (RAM) 85 for control data such as speed information, actuation timings (a timer table), and the like for the shift motors M3*a* and M3*b*, which drive the back folding press members 65*a* and 65*b*.

The control CPU 80 executes a bookbinding process in accordance with a procedure shown in the flowchart in FIG. 10. When predetermined print sheets are set on the collecting tray 22 (St10), the control CPU 80 determines the thickness of the sheet bundle in accordance with a signal from the bundle thickness detecting means St for the sheet bundle (St11). The sheet bundle thickness information is used, in process operations described below, to (1) adjust the amount of adhesive applied by the application roll 51, to (2) set the press time for the back folding press members 65*a* and 65*b*, and to (3) set the cooling time for the back abutting plate 64. Then, the control CPU 80 drives the tray elevating and lowering motor M4 to lower the collecting tray 22 to a carry-out position (shown by a dashed line in FIG. 1) and to deliver the sheet bundle to the bundle conveying means 30. The bundle conveying means 30 changes the posture of the sheet bundle from a horizontal posture to a vertical posture by the swiveling motor M5 (St12).

The control CPU 80 actuates the elevating and lowering motor M7 for the bundle conveying means 30 to transfer the sheets to the paste applying position X (St13). At this time, the CPU 80 varies the sheet bundle conveying amount on the basis of the sheet thickness information, to form the above-described gap Ga between the sheet bundle and the application roll 51. To perform this control, the step count for the elevating and lowering motor M7 is increased or reduced on the basis of the power pulse count; the size of the gap Ga is increased for a thicker sheet bundle and reduced for a thinner sheet bundle. At the same time, the control CPU 80 allows the image forming apparatus A or the inserter apparatus J to feed the cover sheet to the cover binding position K. During this period, the paper thickness of the cover sheet is detected by the cover thickness detecting means th1.

Once the elevating and lowering motor M7 moves by predetermined steps, the control CPU 80 moves the paste container 50 from the home position HP to the return position RP along the going path and then from the return position RP to the home position HP along the returning path. While the paste container 50 is reciprocating as described above, the application roll 51 applies the adhesive to the lower edge S1 of the sheet bundle (St14). In response to a signal (from the home position sensor S7) indicating that the paste container 50 has returned to the home position HP (St15), the control CPU 80 transfers the sheet bundle to the cover binding position (St16).

The above-described control is performed by controlling the step of the elevating and lowering motor M7. In this case, the control CPU 80 controls the elevating and lowering motor M7 so that the predetermined gap Gb is formed between the lower edge S1 of the sheet bundle and the back abutting plate 64. At this time, the control CPU 80 sets the sheet bundle conveying amount depending on the cover thickness detected by the cover thickness detecting means th1 or input via the control panel 81. The control CPU 80 thus adjusts the size of the embossing gap GB to set the size of the adhesion gap gy at a preset value. This sets the size of the gap (adhesion gap) between the back abutting plate member 64 and the adhesion surface of the sheet bundle at the fixed value regardless of the thickness of the cover sheet. The cover sheet regulated by the back abutting plate member 64 is folded back. This prevents the adhesive from leaking from the laterally opposite shoulders of the spine part and also prevents possible inappropriate adhesion resulting from the adhesive having failed to reach the opposite shoulders.

On the other hand, before the operation of transferring the sheet bundle to the cover binding position K, the control CPU 80 has completed the operations of moving the back folding press members 65*a* and 65*b* to the back folding position in FIG. 8(*a*), to the home position in FIG. 8(*b*), and to the standby position in FIGS. 8(*c*) and 8(*d*) and feeding and setting the cover sheet on the cover feeding path P4.

The control CPU 80 then executes the cover binding process (St17). FIG. 8(*e*) shows the process for a thicker sheet bundle, and FIG. 8(*f*) shows the process for a thinner sheet bundle. The back folding press members 65*a* and 65*b* are moved from the standby position WP1 (WP2) to the back folding position PP1 (PP2). The embossing gap Gb has been formed between the back abutting plate member 64 and the lower edge S1 of the sheet bundle. During the back folding operation, the adhesive applied to the lower edge S1 of the sheet bundle is not cooled or solidified, and the spine cover is folded so as to form a flat, sharp straight line.

The control CPU 80 sets a predetermined press time for the state shown in FIG. 8(*e*) or 8(*f*), depending on the thickness of the sheet bundle. The control CPU 80 sets a longer press time for a thicker sheet bundle as shown in FIG. 8(*e*) and a shorter press time for a thinner sheet bundle as shown in FIG. 8(*f*). After the press time is over, the shift motors M3*a* and M3*b* are actuated to move the back folding press members 65*a* and 65*b* to the withdrawal position (home position).

Simultaneously with the withdrawing operation of the back folding press members 65*a* and 65*b*, the control CPU 80 reversely rotates the grip motor M6 for the bundle conveying means 30 to ungrip the sheet bundle (St18). The ungripping operation causes the sheet bundle to fall owing to the weight of the bundle, with the spine part of the bundle abutting against the back abutting plate member 64, as shown in FIG. 8(*g*) (St20). The back cover abutting against the back abutting plate member 64 is formed into a flat surface on the plate plane. At the same time, the adhesive between the spine cover and the sheet bundle is forcibly cooled by the plate. The control CPU 80 thus sets the cooling time in accordance with the signal from the bundle thickness detecting means St and the timer table in the control data storage means (RAM) 85 (St19).

As the time set in accordance with the timer table elapses (St22), the control CPU 80 actuates the elevating and lowering motor M7 to elevate the clampers 33*a* and 33*b* from the state shown in FIG. 8(*g*) to the state shown in FIG. 8(*h*) so that the clampers 33*a* and 33*b* grip the trailing end of the sheet bundle (St21). The control CPU 80 subsequently actuates the grip motor M6 to grip the sheet bundle (St23).

Then, after the predetermined cooling time elapses, the control CPU 80 allows driving means (not shown) to withdraw the back abutting plate member 64 to the outside of the bookbinding path P5. The control CPU 80 actuates the elevating and lowering motor M7 to transfer the sheet bundle to the downstream folding roll 70 (St24). The illustrated folding roll 70 is composed of a pair of rolls. As shown in FIG. 8(*i*), one of the rolls, the roll 70*a*, is configured to be movable between a nip position and a separate position and controlled by actuating means such as a solenoid. In response to a signal from the illustrated sensor S8 indicating that the lower end of the sheet bundle has been detected, the control CPU 80 moves the folding roll 70*a* to the nip position, where the folding roll 70*a* nips and holds the sheet bundle.

After the folding roll nips the sheet bundle, the control CPU 80 allows the grip motor M6 for the bundle conveying means 30 to ungrip the sheet bundle. The control CPU 80 further allows a driving circuit (not shown) to rotationally drive the folding roll 70 (St25). A stacker is provided below the folding roll 70 to house the sheet bundle. Finished sheet bundles are housed in the stacker (St26)

The disclosure of Japanese Patent Application No. 2006-337639 filed on Dec. 14, 2006 is incorporated herein by reference.

While the invention has been explained with reference to the specific embodiments of the invention, the explanation is illustrative and the invention is limited only by the appended claims.

What is claimed is:

1. A bookbinding apparatus comprising:

collecting means on which sequentially fed sheets are collected into a sheet bundle;

a bookbinding path along which the sheet bundle from the collecting means is sequentially supplied for bookbinding;

bundle conveying means located on the bookbinding path for transferring the sheet bundle to a paste applying position and then to a cover binding position;

paste applying means located at the paste applying position for applying an adhesive to a spine part of the sheet bundle;

a cover feeding path crossing the bookbinding path to feed a cover sheet to the cover binding position;

cover binding means located at the cover binding position for binding the sheet bundle with the adhesive applied thereto, to the cover sheet; and cover binding control means for controlling the cover binding means, wherein the cover binding means comprises back folding press members folding back the cover sheet placed on the spine part of the sheet bundle at the cover binding position so that the cover sheet is attached onto the sheet bundle, and a back abutting plate member backing up the cover sheet, the back abutting plate member is located below the back folding press members so that the cover sheet is sandwiched between the back abutting plate member and the spine part of the sheet bundle with a small gap formed between the back abutting plate member and the spine part, the gap between the back abutting plate member and the sheet bundle spine part at the cover binding position being adjustable in size, and the cover binding control means adjusts the size of the gap between the back abutting plate member and the sheet bundle spine part depending on a thickness of the cover sheet when the cover sheet is folded back by the back folding press members.

2. The bookbinding apparatus according to claim 1, wherein the cover binding control means adjusts an amount of the sheet bundle transferred by the bundle conveying means to the cover binding position, or moves a position of the back abutting plate member in a vertical direction, to thereby adjust the size of the gap between the back abutting plate member and the sheet bundle spine part at the cover binding position.

3. The bookbinding apparatus according to claim 1, further comprising cover thickness detecting means located on the cover feeding path for detecting the thickness of the cover sheet, the cover binding control means adjusting the size of the gap between the back abutting plate member and the sheet bundle spine part on a basis of detection information from the cover thickness detecting means.

4. The bookbinding apparatus according to claim 1, wherein the cover binding control means comprises input means through which the thickness of the cover sheet is input to the apparatus, and the size of the gap between the back abutting plate member and the sheet bundle spine part is adjusted on a basis of the cover thickness information input through the input means.

5. The bookbinding apparatus according to claim 1, wherein the cover binding control means sets the size of the gap between the back abutting plate member and the sheet bundle spine part at a larger value for a thicker cover sheet and at a smaller value for a thinner cover sheet.

6. The bookbinding apparatus according to claim 1, further comprising a bundle thickness detecting means for detecting the thickness of the sheet bundle, formed at the collecting means or the bundle conveying means, the paste applying means adjusting an amount of the adhesive applied to the spine part of the sheet bundle depending on the thickness of the sheet bundle detected by the bundle thickness detecting means.

7. The bookbinding apparatus according to claim 1, wherein the back abutting plate member comprises cooling means for cooling the adhesive for solidification, and the cover binding control means executes a back folding process by controlling the back folding press members in a non-contact state in which the back abutting plate member is separated from the cover sheet, and after the back folding process, the folded cover sheet contacts the back abutting plate member and the adhesive is cooled for solidification.

8. An image forming system, comprising:

an image forming apparatus having image forming means for sequentially forming images on sheets; and a bookbinding apparatus according to claim 1, said bookbinding apparatus setting the sheets from the image forming means into the bundle, applying the adhesive to the bundle, and binding the cover sheet to the bundle so that the cover sheet forms the covers.

* * * * *